US008899429B2

(12) United States Patent
Parrinello et al.

(10) Patent No.: US 8,899,429 B2
(45) Date of Patent: Dec. 2, 2014

(54) CLOSING ARRANGEMENT

(71) Applicants: Fiorenzo Parrinello, Medicina (IT); Fabrizio Pucci, Castel Guelfo di Bologna (IT); Bo Larsson, Lund (SE)

(72) Inventors: Fiorenzo Parrinello, Medicina (IT); Fabrizio Pucci, Castel Guelfo di Bologna (IT); Bo Larsson, Lund (SE)

(73) Assignee: Sacmi Cooperativa Meccanici Imola Sociata' Cooperativa (IT)

( * ) Notice: Subject to any disclaimer, the term of this patent is extended or adjusted under 35 U.S.C. 154(b) by 0 days.

(21) Appl. No.: 13/755,657

(22) Filed: Jan. 31, 2013

(65) Prior Publication Data

US 2013/0200032 A1 Aug. 8, 2013

Related U.S. Application Data

(63) Continuation of application No. 12/663,108, filed as application No. PCT/EP2008/056856 on Jun. 3, 2008, now Pat. No. 8,381,924.

(30) Foreign Application Priority Data

Jun. 5, 2007 (IT) ..... MO2007A0192

(51) Int. Cl.
*B65D 51/22* (2006.01)
*B26F 1/18* (2006.01)
*B26D 7/01* (2006.01)

(52) U.S. Cl.
CPC ..... *B65D 51/22* (2013.01); *B65D 51/228* (2013.01); *B26F 1/18* (2013.01); *B26D 7/01* (2013.01); *B65D 2251/0071* (2013.01); *B65D 2251/0015* (2013.01); *B26F 2210/04* (2013.01)
USPC ..... 215/253; 215/252; 220/266

(58) Field of Classification Search
CPC ..... B65D 1/0238; B65D 1/023; B65D 2101/0038; B65D 2101/0092
USPC ..... 215/349, 341, 232, 253, 256, 48, 47, 215/250, 228, 50; 220/265, 266, 293, 288, 220/285, 284, 212, 276; 222/541.6, 541.1; 53/485, 484
IPC ..... B65D 1/02, 53/04, 17/40, 17/28
See application file for complete search history.

(56) References Cited

U.S. PATENT DOCUMENTS

| | | | |
|---|---|---|---|
| 2,317,420 | A | 4/1943 | Taylor |
| 2,542,350 | A | 9/1948 | Paulsen |
| 3,902,619 | A | 9/1975 | Gouget |
| 4,181,232 | A | 1/1980 | Bellamy et al. |
| 4,402,415 | A | 9/1983 | Hopley |
| 4,662,529 | A | 5/1987 | Moore |
| 5,090,581 | A | 2/1992 | Rose et al. |
| 5,660,289 | A | 8/1997 | Spatz et al. |

(Continued)

FOREIGN PATENT DOCUMENTS

| | | | |
|---|---|---|---|
| EP | 0194068 | A2 | 9/1986 |
| EP | 0421821 | A1 | 4/1991 |

(Continued)

*Primary Examiner* — Robert J Hicks
(74) *Attorney, Agent, or Firm* — Laubscher & Laubscher, P.C.

(57) ABSTRACT

A closing arrangement includes a neck having an end closed by a wall and an associated cap. The end of the neck is provided with a weakening line that surrounds the neck. The cap is provided with an opening promoting device arranged for engaging with a further opening promoting device of the wall to separate at least a part of the wall of the neck along the weakening line.

16 Claims, 23 Drawing Sheets

(56) References Cited

U.S. PATENT DOCUMENTS

| | | | |
|---|---|---|---|
| 5,913,434 | A | 6/1999 | Fukuhara et al. |
| 6,220,466 | B1 | 4/2001 | Hayes et al. |
| 2005/0005757 | A1 | 1/2005 | Kowal |

FOREIGN PATENT DOCUMENTS

| | | | |
|---|---|---|---|
| EP | 1129956 | A1 | 9/2001 |
| FR | 2150226 | A | 4/1973 |
| GB | 2080775 | A | 2/1982 |
| JP | 2005-145494 | A | 6/2006 |
| JP | 2007261599 | A | 10/2007 |

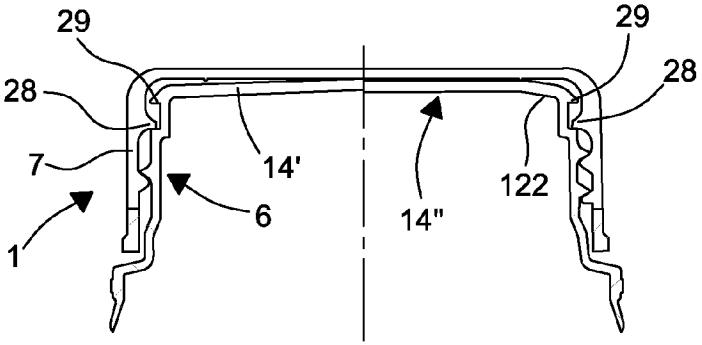
Fig. 43
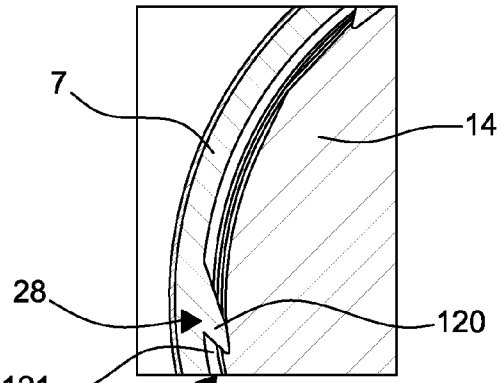
Fig. 42
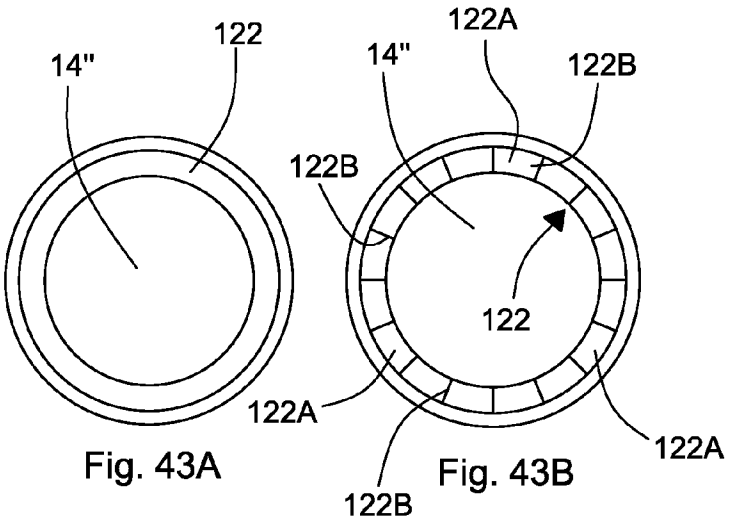
Fig. 43B
Fig. 43A
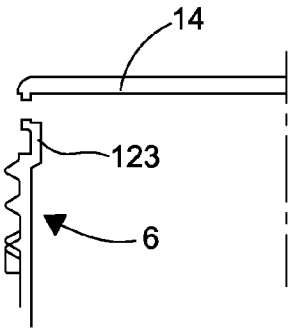
Fig. 45
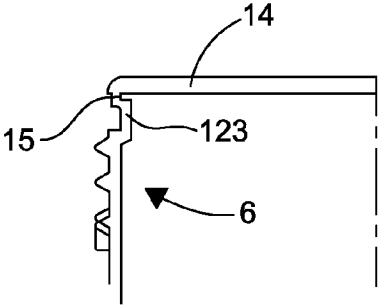
Fig. 44

CLOSING ARRANGEMENT

This application is a continuation of U.S. application Ser. No. 12/663,108 filed Dec. 4, 2009 PCT International Application No. PCT/EP2008/056856 filed Jun. 3, 2008. PCT/EP2008/056856 claims priority to IT Application No. MO2007A000192 filed Jun. 5, 2007. The entire contents of this application are incorporated herein by reference.

The invention relates to a closing arrangement for a container, comprising a neck with which a cap is associable. In particular, the closing arrangement can be provided with a container part comprising, in addition to the aforesaid neck, an end zone of a container body.

The invention further relates to a closing arrangement provided with a weakening line.

Closing devices are known that are associable with containers, in particular with containers obtained from a sheet of multilayered material, comprising a dispensing nozzle and a cap associable with the dispensing nozzle. The dispensing nozzle comprises a base that is fixable to a container body and a neck that is provided with a thread arranged for cooperating with a corresponding further thread provided inside the cap. The neck comprises a side wall, in which the aforesaid thread is obtained, and an end wall. The end wall defines, together with an upper portion of the side wall, a closing element arranged for being removed from the neck when the closing element is opened for the first time.

The cap is provided with a plurality of penetrating elements, that extend from a side shell of the cap to the inside of the cap, which penetrating elements are arranged for removing the aforesaid closing element from the neck when the cap is unscrewed from the neck.

The penetrating elements comprise an edge arranged for cutting a portion of the material that forms the neck in such a way as to separate the closing element from the neck. The dispensing nozzle is obtained from a disc made of plastics that is vacuum thermoformed directly inside the cap. In other words, the cap acts as a mould cavity for forming the dispensing nozzle.

In order to manufacture the closing devices disclosed above very complex and costly moulds are necessary.

In particular, in order to obtain caps comprising penetrating elements that have great stiffness and a sharp edge special moulds are necessary.

Further, the aforesaid moulds have to operate with rather slow work cycles, which noticeably limit the efficiency of forming apparatuses that are equipped with such moulds.

The manufacturing process for manufacturing the closing devices disclosed above is further complicated by the fact that the dispensing nozzle has to be formed directly inside the cap.

Caps are known—for example of the screw cap type, or of the snap cap type—that are associable with containers for closing a dispensing opening thereof.

These caps comprise a side shell from which a tamperproof ring leads away that acts as an indicating element indicating that the cap has been opened. Between the side shell and the tamperproof ring there is provided a weakening line defined by a plurality of breakable bridge elements that are intended to be fractured when the cap is removed from the container for the first time. The breakable bridge elements can be obtained by providing ribs projecting inside the cap from a wall of the cap that defines the cylindrical shell and the tamperproof ring and making a cut that completely passes through the thickness of said wall, but which does not completely pass through the thickness of said ribs.

Alternatively, ribs are not provided and, through a suitably shaped blade, through cuts are made in the aforesaid wall between which non-cut portions are interposed that define the breakable bridge elements.

A drawback of the caps disclosed above is that when the cap is removed from the container for the first time, the breakable bridge elements are deformed axially in a significant manner, before breaking. The seal between the cap and the container therefore is lacking before the breakage of the breakable bridge elements.

Further, after the breakable bridge elements have been broken, in the breaking zones there are flashes and residue of plastics—with which the caps are made—that detract from the appearance of the caps and, being pointed and/or sharp, may accidentally injure a user. FR 2150226 discloses a cap, a ring detachably connected to the cap, a pointed blade projecting from the internal surface of the ring, and a container neck having a peripheral groove with a reduced thickness which is engaged by the point of the blade.

Each of patent publications EP 1129956, EP 1946068, U.S. Pat. No. 4,181,232 and U.S. Pat. No. 2,317,420 discloses a closing device having a neck and an associated cap.

Each of patent publications U.S. Pat. No. 5,660,289 and US 2005/005757 a container cap including a guarantee area containing a vertical incision arranged to depend on the holding webs of the cap.

An object of the invention is to improve known closing arrangements.

Another object of the invention is to obtain a closing arrangement comprising a closing portion that initially defines a part of a neck of the closing arrangement and that is subsequently removed by a cap of the closing arrangement when the cap is removed from the neck, which closing arrangement is very simple to manufacture.

A further object is to obtain a closing arrangement comprising a weakening line that is simple to be made and enables the cap to be opened effectively.

In a first aspect of the invention, there is provided a closing arrangement, comprising a container part provided with an end zone of a container body and with a neck with which a cap is associable, the neck having an end closed by a wall, in the end there being provided a weakening line that surrounds the neck, the cap being provided with an opening promoting device arranged for engaging a further opening promoting device of the wall to separate at least a part of the wall from the neck along the weakening line.

Owing to this aspect of the invention it is possible to obtain a closing arrangement that is simpler to manufacture than the known closing devices.

As the weakening line significantly facilitates the removal from the neck of at least a part of the aforesaid wall, the opening promoting device and the further opening promoting device may have rather a simple shape. Consequently, the container part and the cap can be formed using conventional molds. In particular, owing to the weakening line—which promotes a first opening of the closing arrangement—the opening promoting device, unlike what occurs in known closing devices, does not have to be provided with stiff and sharp penetrating elements that cut the material, for example synthetic plastic, that form a wall of the closing devices. In the cap according to the invention, in fact, the opening promoting device, by cooperating with the further opening promoting device, fractures the plastic along the weakening line without having to penetrate the aforesaid plastic to cut the plastic.

In addition, as the opening promoting device has a much simpler configuration than the penetrating elements of the known closing devices, the container part can be formed into a dedicated mold—and not directly inside the cap—and be associated with the cap subsequently, which significantly simplifies the manufacturing process for manufacturing the container part and enables the precision of coupling between the cap and the neck to be improved.

In an embodiment, the closing arrangement comprises a container part provided with an end zone of a container body and of the aforesaid neck.

In a second aspect of the invention, there is provided a closing arrangement, comprising a first element and a second element between which a weakening line is provided, wherein the weakening line comprises at least a first weakened portion and at least a second weakened portion, the at least a first weakened portion and the at least a second weakened portion extending from opposite sides of a wall of the closing arrangement through a part of the thickness of the wall.

Owing to this aspect of the invention, it is possible to obtain a closing arrangement in which a wall zone of the cap in which there is the weakening line does not stretch significantly when the first element and the second element are moved away from one another.

Further, after the first element and the second element have been separated from one another along the weakening line, in the aforesaid wall zone there are much fewer flashes and/or residues than in the case of known breakable bridge elements. In addition, the weakening line can be obtained with a degree of repeatability that is greater than is the case with known bridge elements.

In the cap according to the invention, the at least a first weakened portion and the at least a second weakened portion can be made, for example, by a blade, by means of an ultrasound device, by a laser device, by reducing the wall zone thickness obtained directly in a forming mold in which the closing arrangement is formed, etc.

In all the aforesaid cases, the width of the weakened portion—and, consequently, the force that a user has to apply to the closing arrangement to separate the first element from the second element—can be controlled precisely and be maintained substantially constant.

On the other hand, in the case of known bridge elements, the interaction of a continuous blade with a wall provided with ribs, or the interaction of a shaped blade with a continuous wall, are very difficult to control, for example due to blade wear and/or deformability of the plastics which form the objects in which incisions are to be made. Consequently, the breakable bridge elements may have cross sections having an extent that differs significantly from a theoretically provided extent, which involves significant variations of the force that has to be applied by a user to break the breakable bridge elements.

The invention can be better understood and implemented with reference to the attached drawings, which show some embodiments thereof by way of non-limiting example, in which:

FIG. 42 is a cross section of the closing arrangement of FIG. 40, in an open configuration;

FIG. 43 is a section taken along a longitudinal plane of two still further embodiments of the closing arrangement, a first still further embodiment being shown at the left half of the Figure and a second still further embodiment being shown at the right half of the Figure;

FIG. 43A is a view from above of the second still further embodiment of the closing arrangement shown in FIG. 43;

FIG. 43B is a view from above of a variation of the second still further embodiment shown in FIGS. 43 and 43A;

FIG. 44 is a section taken along a longitudinal plane of another embodiment of the closing arrangement, in a closed configuration;

FIG. 45 is a section like the section of FIG. 44, with the closing arrangement in an open configuration;

Figure 1:
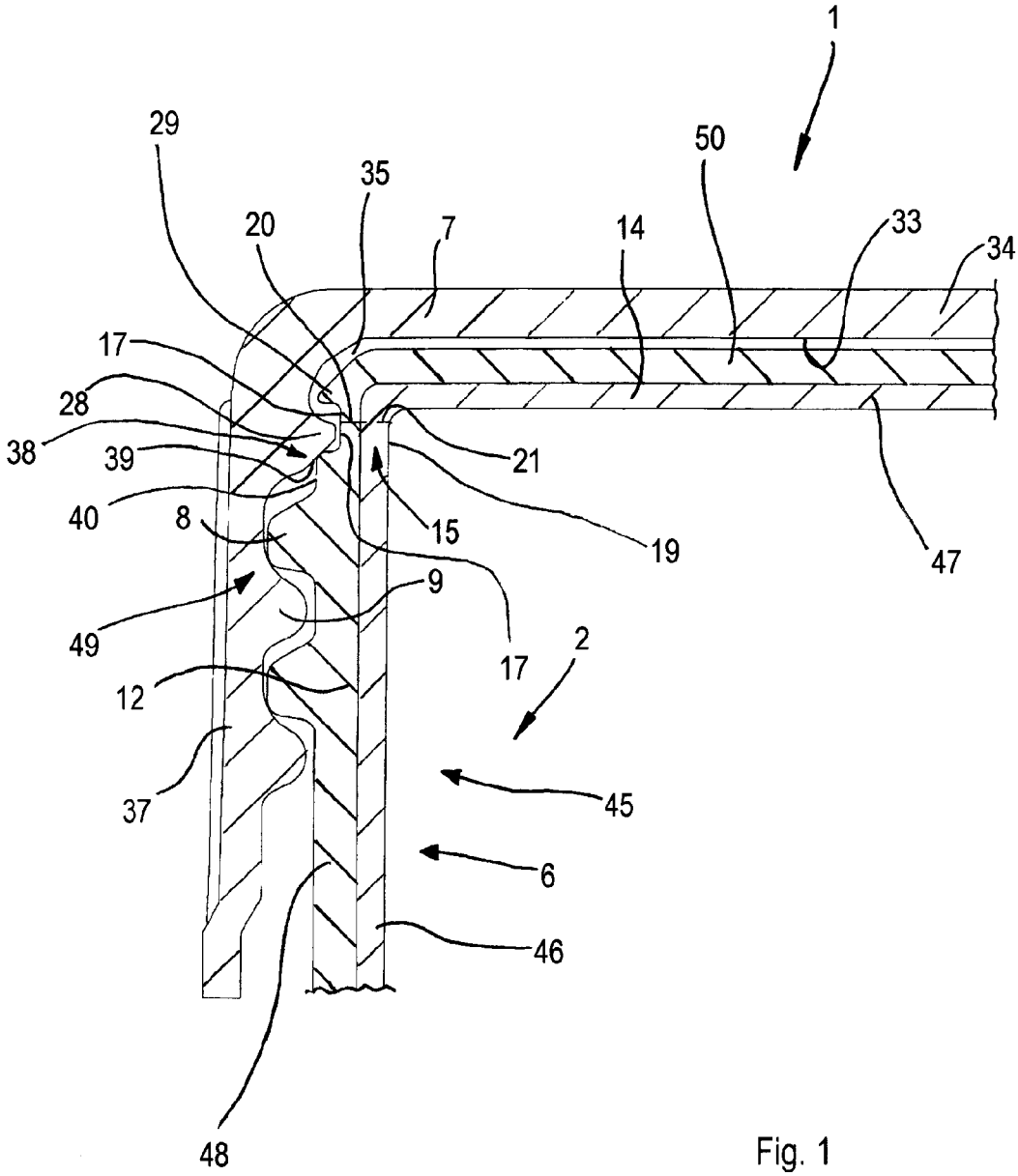
FIG. 1 is a partially fragmentary section, taken along a longitudinal plane, of a closing arrangement.
Figure 3:
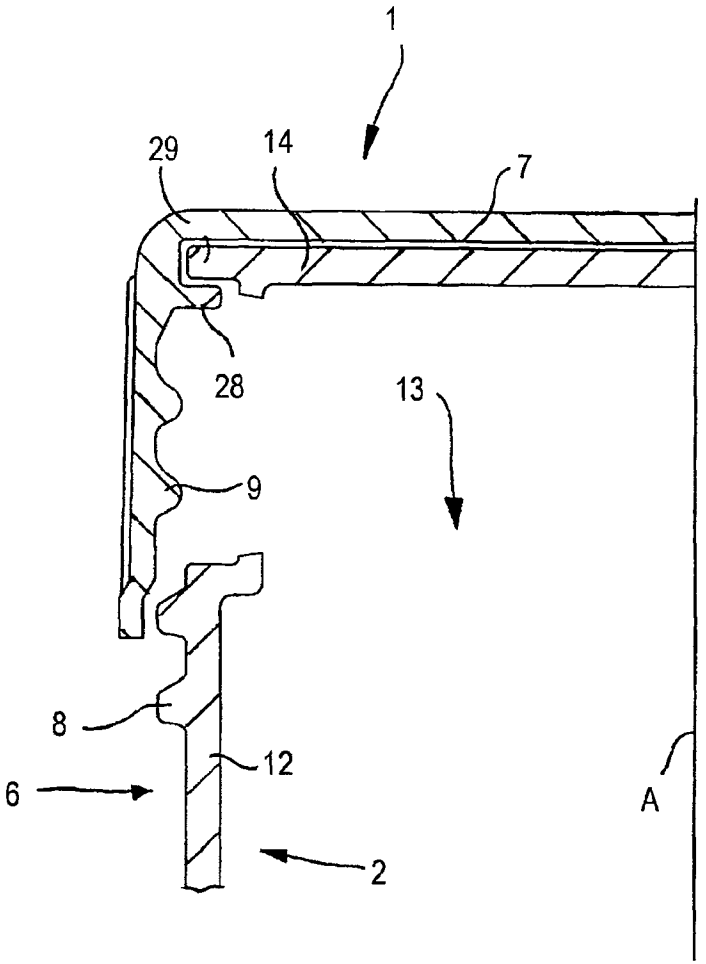
FIG. 3 is a section like the one in FIG. 1 showing the closing arrangement in FIG. 2 in an open configuration.
Figure 2:
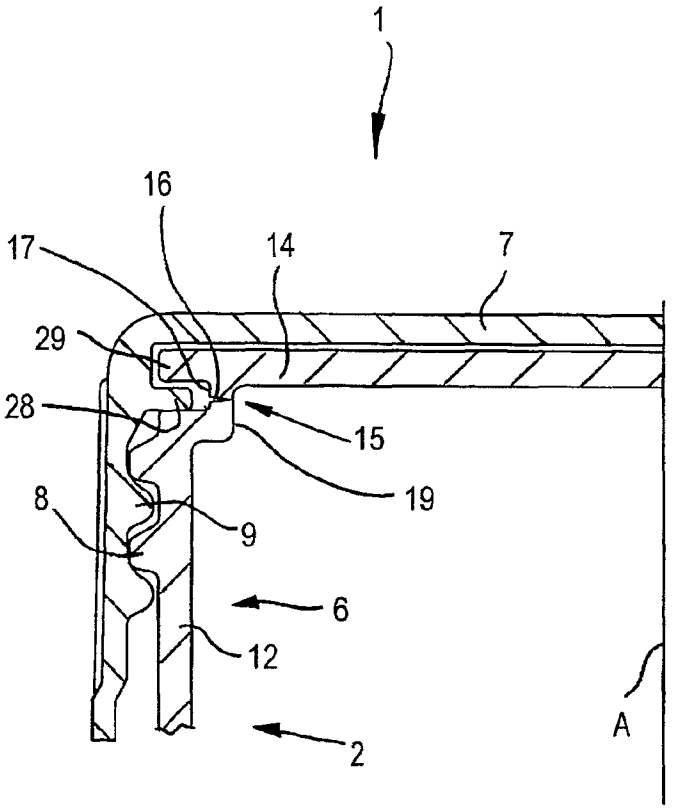
FIG. 2 is a section like the one in FIG. 1 showing an embodiment of the closing arrangement in a closed configuration.

With reference to FIGS. 1 to 10, 15 and 16, there is shown a closing arrangement 1 comprising a container part 2 provided with an end zone of a container 3 that defines a base element 4 of the container part 2 having an open end 5. The container part 2 further comprises a neck 6 with which a cap 7 is associable.

The container part 2 is associable with a container body, for example a container made of cardboard, or made of a multi-layered laminar element obtained by associating one or more sheets of cardboard with one or more sheets of plastics and/or metal material.

The container part 2 may comprise a layer made of a barrier material that is a barrier to gas and/or to light.

As shown in FIGS. 1 to 8, 15 and 16, the neck 6 can be provided with a thread 8 arranged for cooperating with a further thread 9 provided inside the cap 7. In this case the cap 7 is of the screw cap type.

Figure 9:
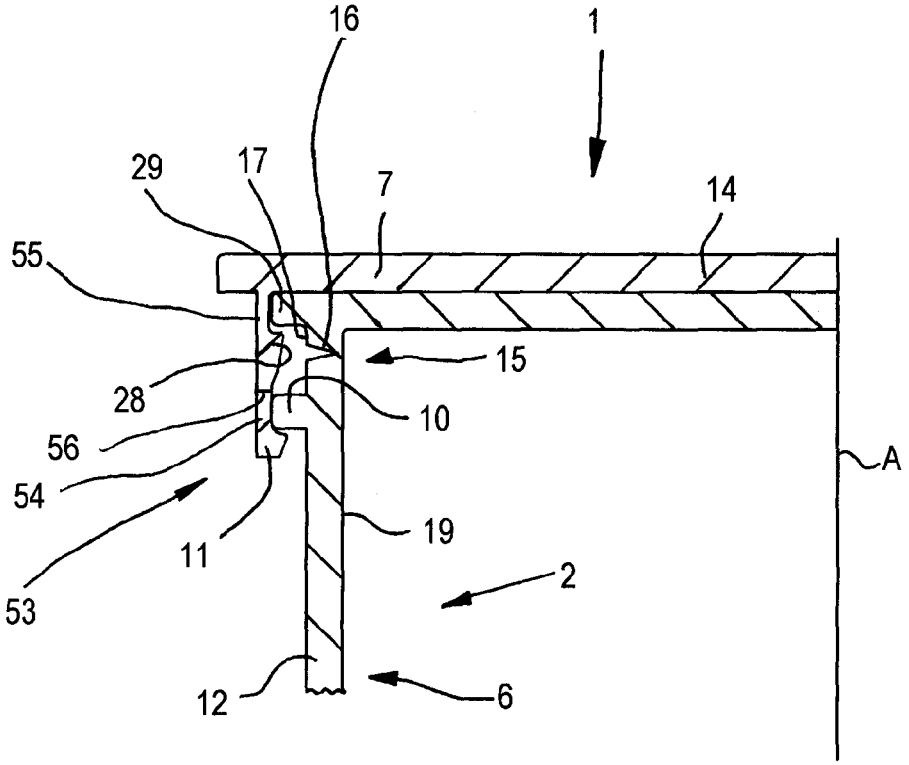
FIG. 9 is a section like the one in FIG. 1 showing a still further embodiment of the closing arrangement.
Figure 10:
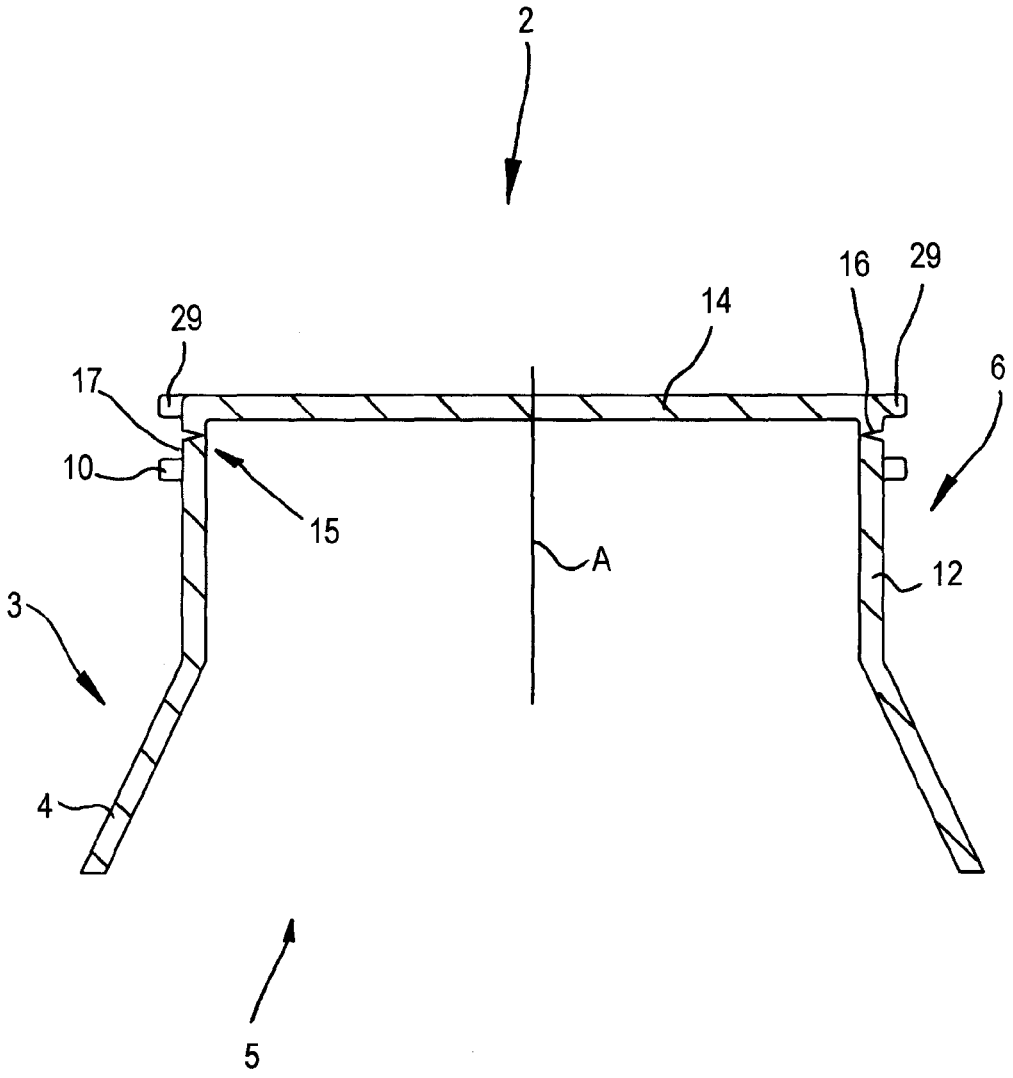
FIG. 10 is a section like the one in FIG. 1 showing a container part of the closing arrangement in FIG. 9.
Figure 11:
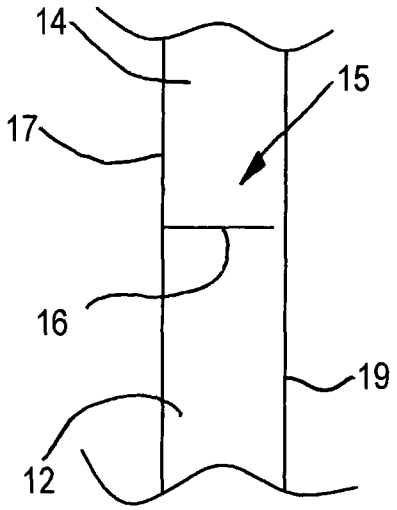
FIG. 11 is a schematic section taken along a longitudinal plane showing a weakening line of the closing arrangement.

Alternatively, as shown in FIGS. 9 and 10, the neck 6 can be provided with a ridge 10 arranged for cooperating with a hooking arrangement 11 with which the cap 7 is provided. In this case, the cap 7 is of the snap cap type. The hooking arrangement 11 is provided with an opening indicator device 53 that indicates that the closing arrangement 1 has been opened. The opening indicator device 53 comprises a tamperproof ring 54. Between the tamperproof ring 54 and a body 55 of the cap 7 an intended opening line 56 is provided.

The neck 6 comprises a side wall 12—which defines a dispensing opening 13—and an end portion 14 made as a monobloc.

Between the side wall 12 and the end portion 14 a weakening line 15 is interposed.

The weakening line 15 may extend along the entire peripheral region of the neck 6, or only along one or more zones thereof. In other words, the weakening line 15 may be substantially continuous, or fragmentary in such a way that the peripheral region of the neck comprises zones in which the weakening line 15 extends, between the aforesaid zones there being interposed further zones in which the weakening line 15 does not extend.

As shown in FIGS. 1 to 5 and 7 to 16, the weakening line 15 may be obtained by making one, or several, non-through incisions through the thickness of the neck 6.

The aforesaid non-through incisions may be made mechanically, for example by cutting tools, or by ultrasound devices, or laser devices.

In FIGS. 2, 3 and 7 to 11 there is provided only one non-through incision 16 extending from an external face 17 of a wall of the neck 6 transversely with respect to a longitudinal axis A of the closing arrangement 1. In particular, the non-through incision 16 extends substantially perpendicularly with respect to the longitudinal axis A.

In an embodiment that is not shown, the non-through incision extends from an internal face 19 of a wall of the neck 6.

Figure 5:
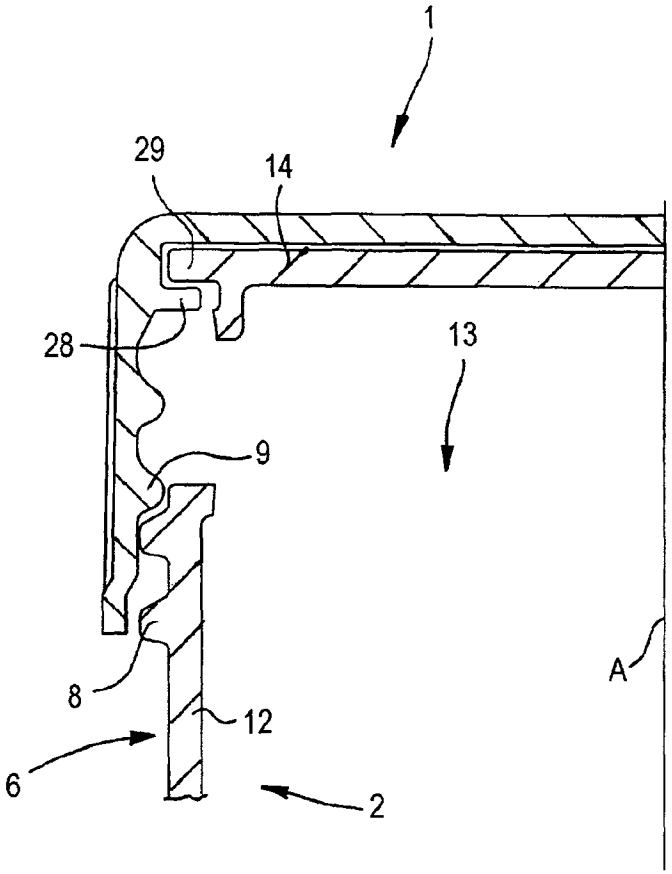
FIG. 5 is a section like the one in FIG. 1 showing the closing arrangement in FIG. 4 in an open configuration.
Figure 4:
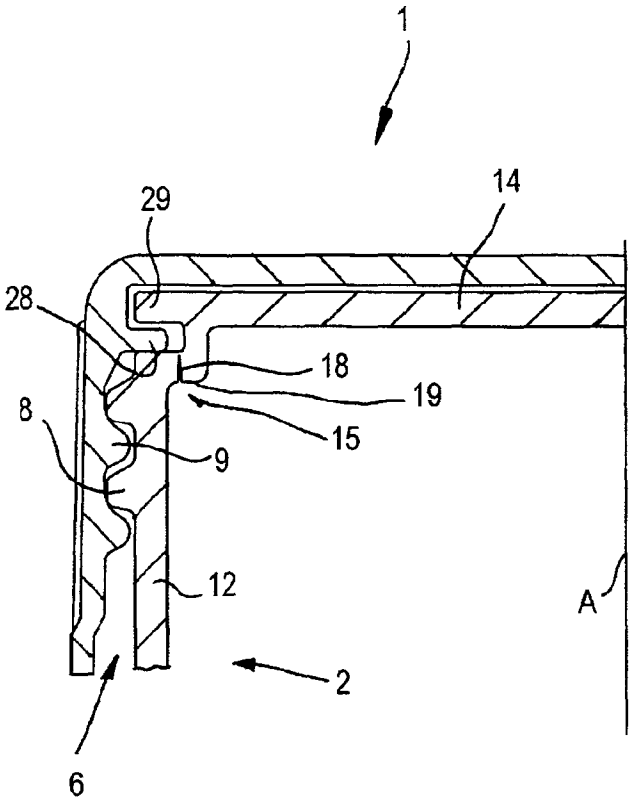
FIG. 4 is a section like the one in FIG. 1 showing another embodiment of the closing arrangement in a closed configuration.

In FIGS. 4 and 5 there is provided only one non-through incision 18 extending from an internal face 19 of a wall of the neck 6 substantially parallel to the longitudinal axis A.

In an embodiment that is not shown, the non-through incision extends from an external face 17 of a wall of the neck 6.

In FIGS. 1, 13, 15 and 16 there are provided two non-through incisions, a first non-through incision 20 extending from an external face 17 of a wall of the neck 6 and a second non-through incision 21 extending from an internal face 19 of a wall of the neck 6.

The first non-through incision 20 and the second non-through incision 21 extend transversely to the longitudinal axis A. In particular, the first non-through incision 20 and the second non-through incision 21 extend substantially perpendicularly to the longitudinal axis A.

The first non-through incision 20 and the second non-through incision 21 are aligned.

The first non-through incision 20 and the second non-through incision 21 define a plane.

In an embodiment that is not shown, the first non-through incision 20 and the second non-through incision 21 extend substantially parallel to the longitudinal axis A, similarly to what is shown in FIGS. 4 and 5.

Figure 12:
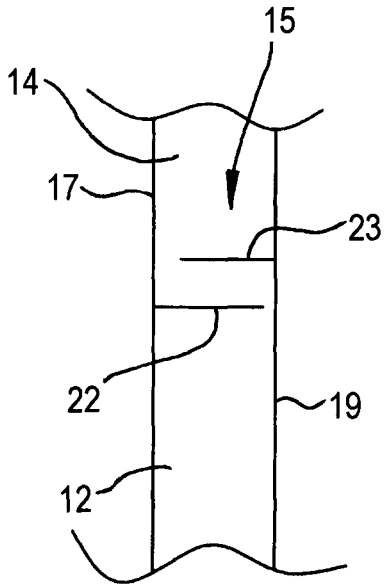
FIG. 12 is a section like the one in FIG. 11 showing an embodiment of the weakening line.

In FIG. 12 there are provided two non-through incisions, a first non-through incision 22 extending from an external face 17 of a wall of the neck 6 and a second non-through incision 23 extending from an internal face 19 of a wall of the neck 6.

The first non-through incision 22 and the second non-through incision 23 extend transversely to the longitudinal axis A. In particular, the first non-through incision 22 and the second non-through incision 23 extend substantially perpendicularly to the longitudinal axis A.

The first non-through incision 22 and the second non-through incision 23 are staggered along the longitudinal axis A.

The first non-through incision 20 and the second non-through incision 21 define two planes that are substantially parallel to one another.

The first non-through incision 22 can be more distant from (as shown in FIG. 12), or nearer to, the end portion 14 than the second non-through incision 23.

In an embodiment that is not shown, the first non-through incision 22 and the second non-through incision 23 extend substantially parallel to the longitudinal axis A, similarly to what is shown in FIGS. 4 and 5.

The first non-through incision 22 and the second non-through incision 23 are staggered being arranged at different distances from the longitudinal axis A. The first non-through incision 22 can be more distant from, or nearer to, the longitudinal axis A.

Figure 14:
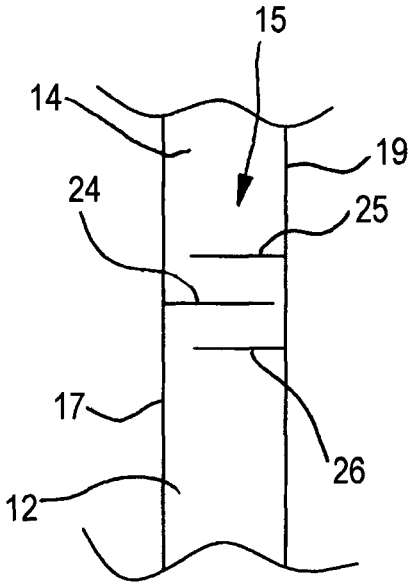
FIG. 14 is a section like the one in FIG. 11 showing a further embodiment of the weakening line.

In FIG. 14 there are provided three non-through incisions, a first non-through incision 24 extending from an external face 17 of a wall of the neck 6, a second non-through incision 25 and a third non-through incision 26 extending from an internal face 19 of a wall of the neck 6.

The first non-through incision 24, the second non-through incision 25 and the third non-through incision 26 extend transversely to the longitudinal axis A. In particular, the first non-through incision 24, the second non-through incision 25 and the third non-through incision 26 extend substantially perpendicularly to the longitudinal axis A.

The first non-through incision 24, the second non-through incision 25 and the third non-through incision 26 are staggered along the longitudinal axis A in such a way that the first non-through incision 24 is interposed between the second non-through incision 25 and the third non-through incision 26.

In an embodiment that is not shown, the first non-through incision 24, the second non-through incision 25 and the third non-through incision 26 extend substantially parallel to the longitudinal axis A, similarly to what is shown in FIGS. 4 and 5.

The first non-through incision 24, the second non-through incision 25 and the third non-through incision 26 are staggered, being arranged at different distances from the longitudinal axis A.

In an embodiment that is not shown, there are provided three non-through incisions, a first non-through incision extending from an internal face 19 of a wall of the neck 6, a second non-through incision and a third non-through incision extending from an external face 17 of a wall of the neck 6.

Figure 6:
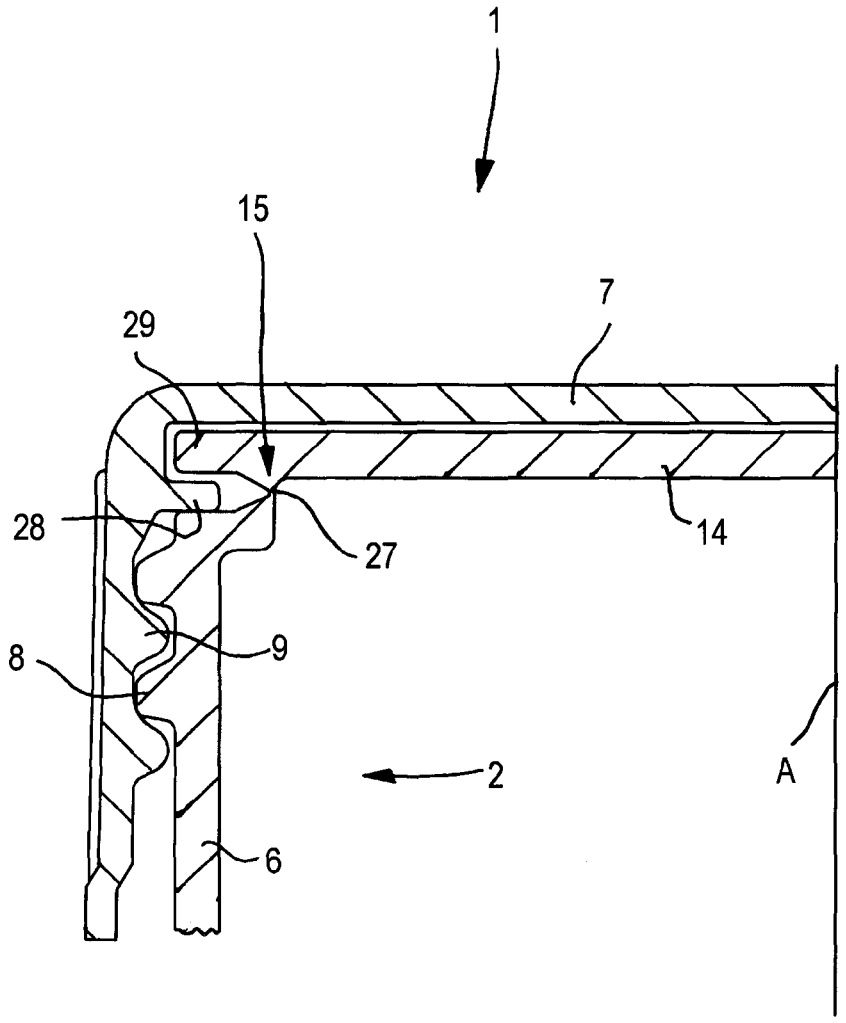
FIG. 6 is a section like the one in FIG. 1 showing a further embodiment of the closing arrangement.
Figure 7:
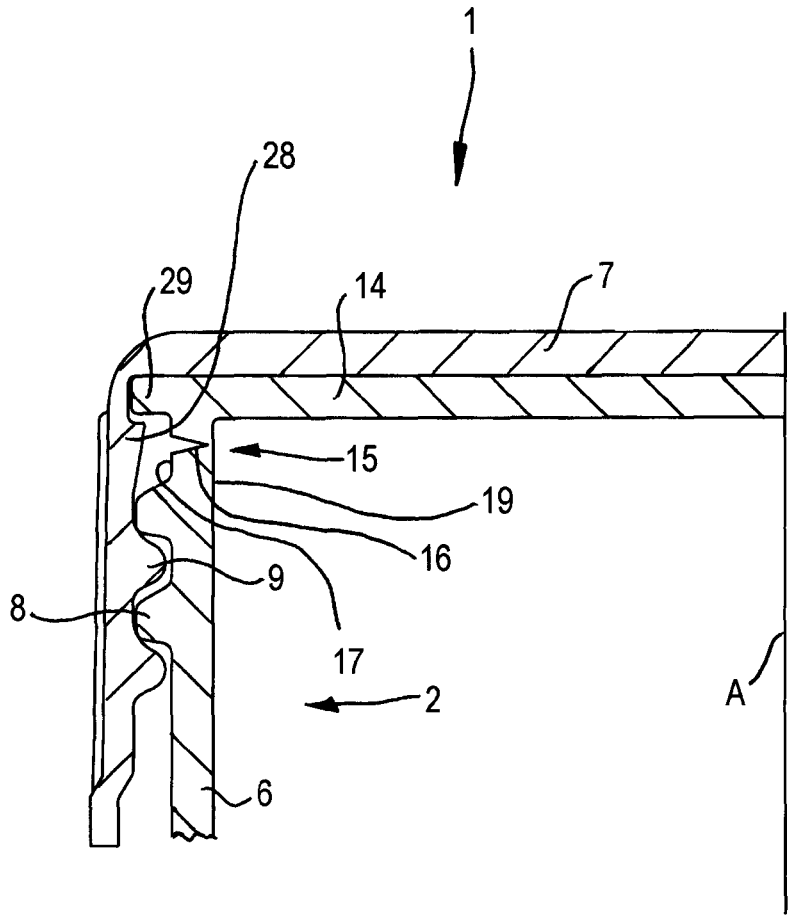
FIG. 7 is a section like the one in FIG. 1 showing a still further embodiment of the closing arrangement.
Figure 8:
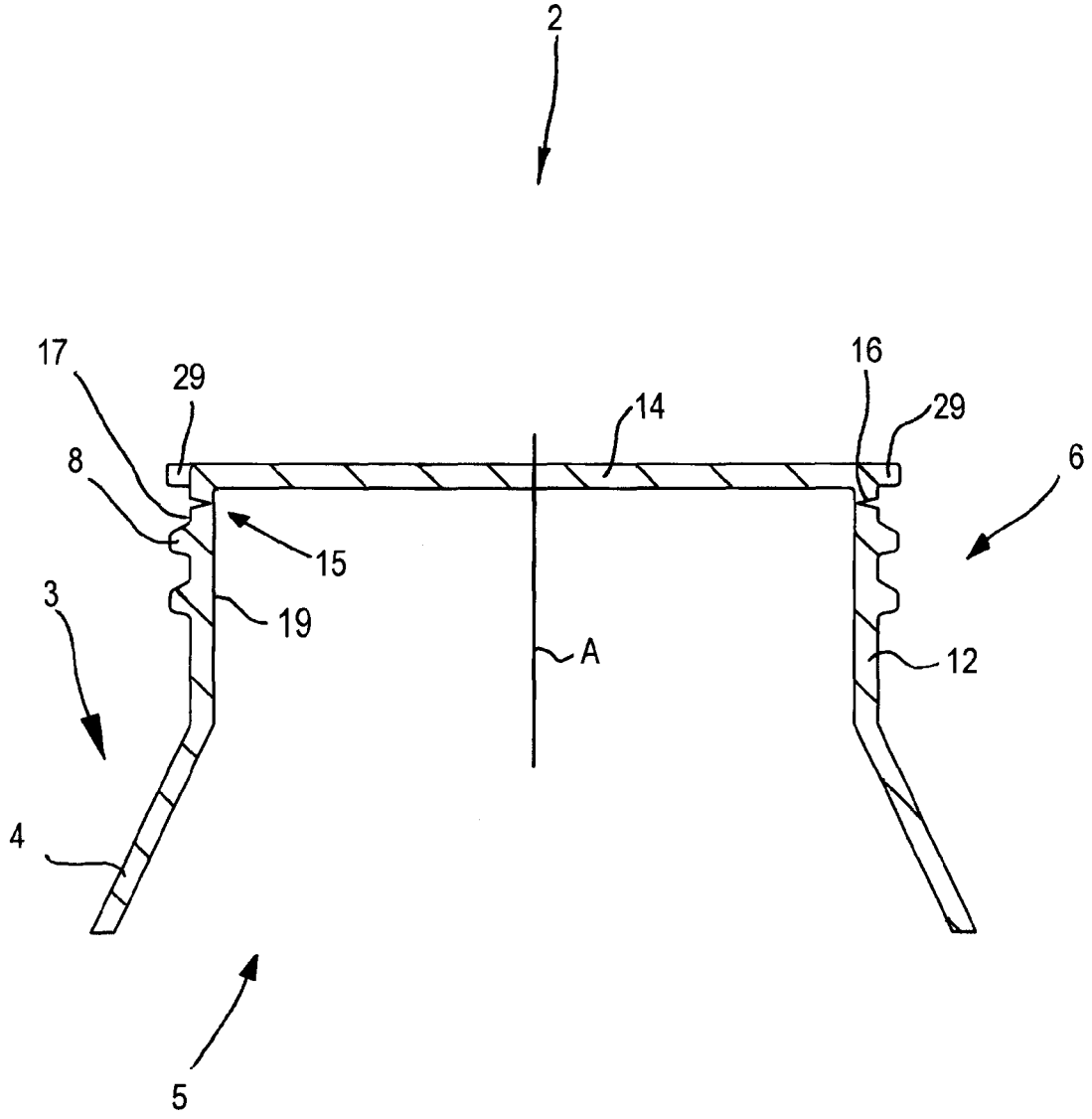
FIG. 8 is a section like the one in FIG. 1 showing a container part of the closing arrangement in FIG. 7.

Alternatively, as shown in FIG. 6, the weakening line 15 can be obtained—for example directly during the step of forming the neck 6—making a neck 6 provided with a wall having a zone 27 with a thinner thickness than a remaining part of wall.

The zone with a thinner thickness can be arranged transversely—and in particular substantially perpendicularly—with respect to the longitudinal axis A, or substantially parallel to the longitudinal axis A.

The neck 6 can be provided, instead of with a single zone with a thinner thickness, with a plurality of zones with a thinner thickness arranged similarly to the non-through incisions that have been disclosed above.

The cap 7 is provided with an opening promoting device 28 arranged for engaging a further opening promoting device 29 of the end portion 14 for separating the end portion 14 from the neck 6 along the weakening line 15.

The opening promoting device 28 may entirely, or only partially, occupy a perimeter zone of the cap 7.

The opening promoting device 28 can be shaped as a continuous element, or as a plurality of distinct elements that are adjacent to one another.

If the opening promoting device comprises a plurality of distinct elements, these distinct elements can be staggered along the longitudinal axis.

In this way, in a first instant of the opening operations of the closing arrangement 1, the contact between the opening promoting device 28 and the further opening promoting device 29 occurs in a localized manner—in a zone of reduced extent—and not along the entire perimeter of the neck 6. The end portion 14 is separated from the neck 6 in a progressive manner, which requires a user to exert less force than if the aforesaid distinct elements are arranged on the same plane substantially perpendicularly to the longitudinal axis A. In particular, in the case of a cap 7 of the screw-cap type, less unscrewing torque is required to remove the cap 7—and the end portion 14—from the neck 6.

As shown in FIGS. 1 to 7 and 9, the opening promoting device 28 may comprise a hook arrangement that projects inside the cap 7.

Figure 15:
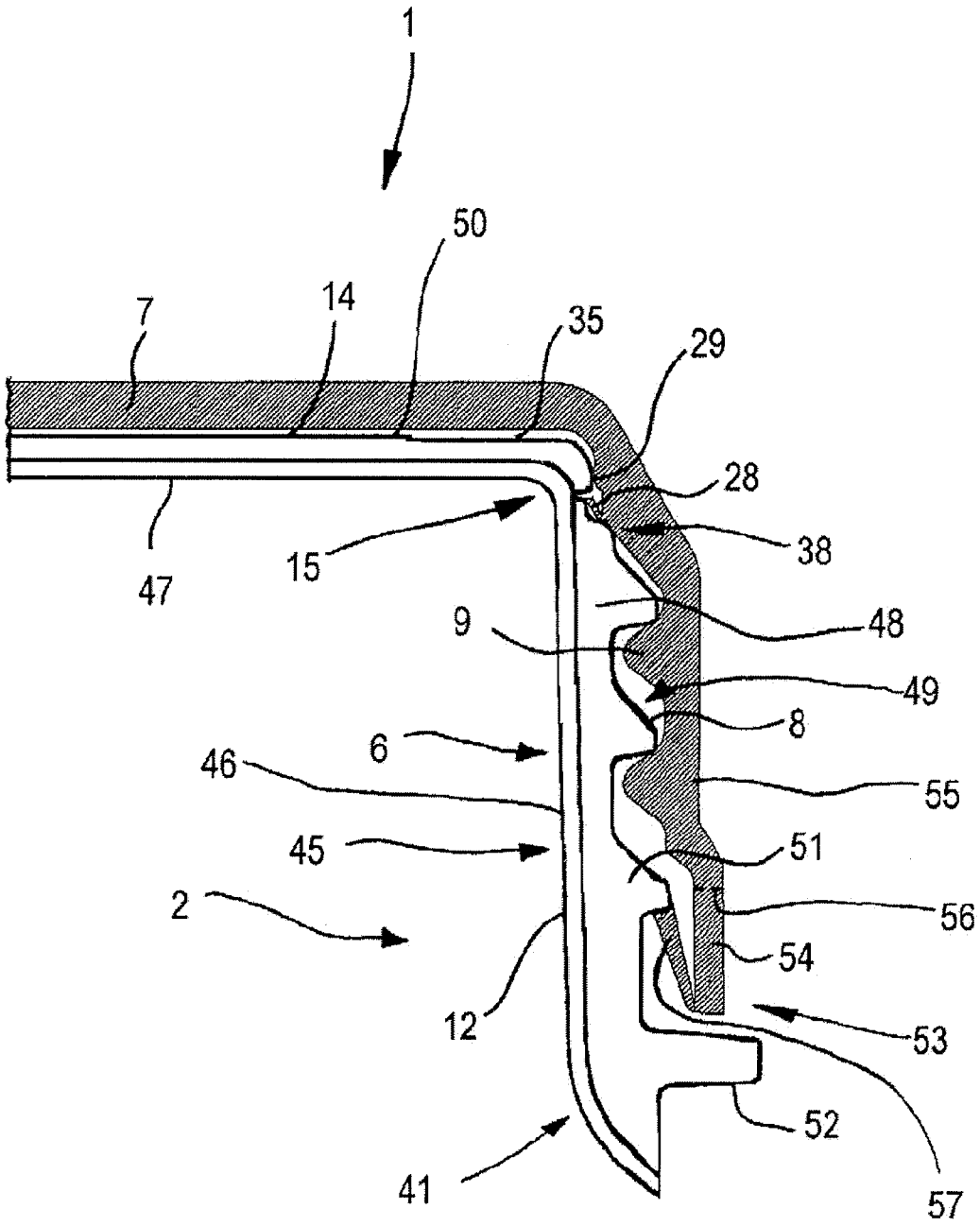
FIG. 15 is a section taken along a longitudinal plane of a further embodiment of the closing arrangement.
Figure 16:
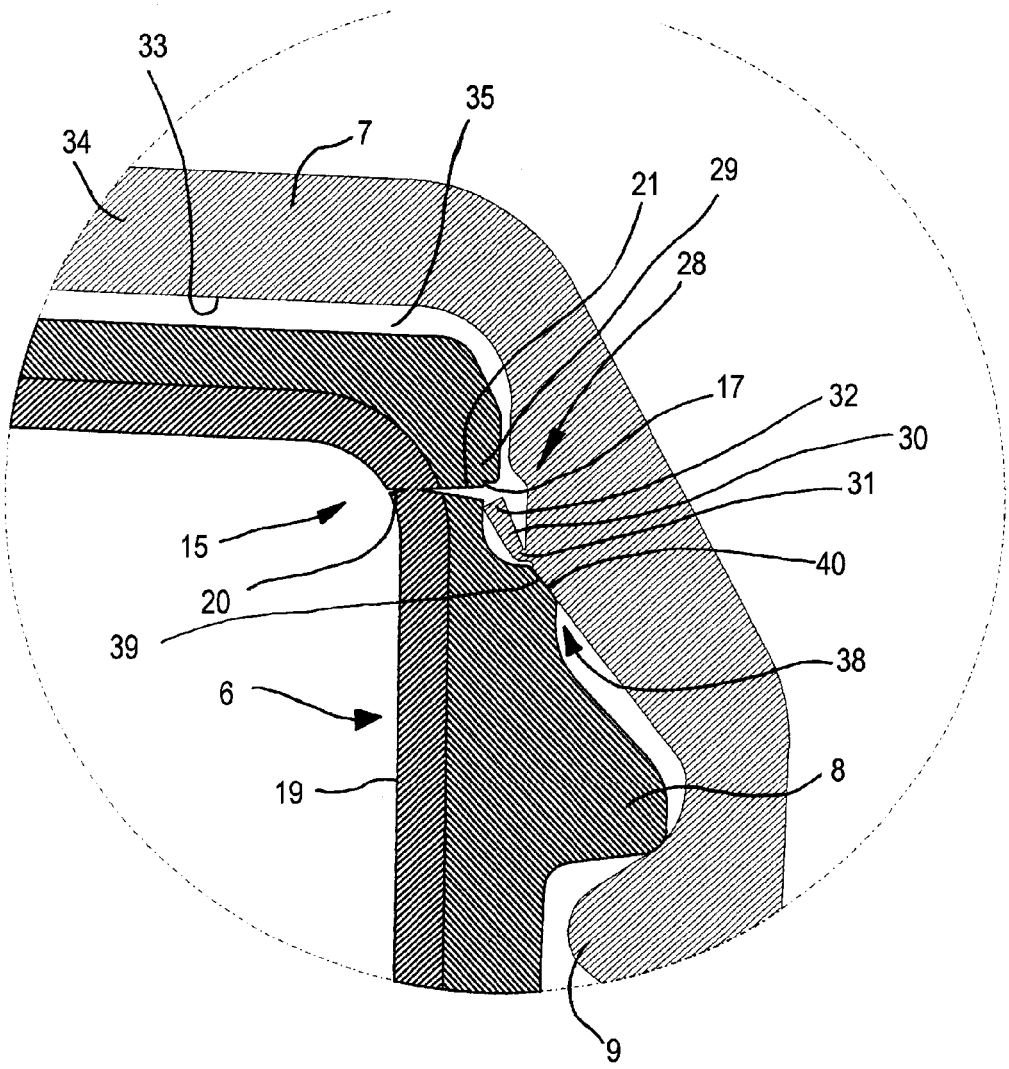
FIG. 16 is a detail of FIG. 15.

As shown in FIGS. 15 and 16, the opening promoting device 28 may comprise a tab arrangement 30 having an end 31 hinged on the cap 7 and a further end 32, opposite the end 31, arranged for interacting with the further opening promoting device 29. The tab arrangement 30 may comprise a plurality of distinct tabs, or a continuous tab. The tab arrangement 30—in addition to acting as hooking elements cooperating with the further opening device 29—exert an inward thrust inside the closing arrangement 1 that effectively stresses the weakening line 15 so as to facilitate breaking thereof. In other words, the tab arrangement 30 not only engages with the further opening promoting device 29, but also inserts itself as a wedge between the neck 6 and the end portion 14, promoting mutual detachment thereof.

The opening promoting device 28 is shaped in such a way that the end portion 14 is retained by the cap 7 after being removed from the neck 6. In particular, the end portion 14 is retained in a containing zone 35 of the cap 7 defined by the opening promoting device 28 and by an internal surface 33 of a base wall 34 of the cap 7. During fitting of the cap 7 onto the neck 6 to obtain the closing arrangement 1, the opening promoting device 28 and the further opening promoting device 29 are elastically deformed in such a way that the end portion 14 is received inside the containing zone 35 so as not to be able to exit the containing zone 35 in a non-intentional manner, i.e. without a user deliberately extracting the end portion 14 from the containing zone 35, for example to access promotional indications and/or messages associated with the internal surface 33.

The closing arrangement 1 may comprise positioning devices, that are not shown, arranged for positioning the end portion 14 with respect to the cap 7—and consequently with respect to the neck 6—when the cap 7, after the closing arrangement 1 has been opened for the first time, is again applied to the neck 6. The end portion 14, by occupying an undesired position, could make repositioning of the cap 7 on the neck 6 more difficult or even prevent it.

The positioning devices may comprise projecting bodies that project from the end portion 14 and are received in cavities obtained in the base wall 34.

Alternatively, the positioning devices may comprise projecting bodies that project from the base wall 34 and are received in cavities obtained in the end portion 14.

Still alternatively, the positioning devices may comprise tab elements extending radially from the end portion 14 and interacting with an internal surface of a cylindrical shell 37 of the cap 7.

As shown in FIGS. 1 and 16, the closing arrangement 1 comprises a seal arrangement 38 arranged for preventing a product contained inside the container exiting the latter once the cap 7—after the closing arrangement 1 has been opened for the first time—has again been applied to the neck 6.

The seal arrangement 38 comprises a ridge 39 of the cap 7 and a further ridge 40 of the neck 6 that cooperate together.

Owing to the seal arrangement 38, the position of the end portion 14 with respect to the cap 7—i.e. the position of the end portion 14 inside the containing zone 35—does not affect the seal of the closing arrangement 1, when the cap 7 is again applied to the neck 6. The seal arrangement 38 is in fact shaped in such a way that the seal is provided by the ridge 39 and by the further ridge 40 regardless of the position of the end portion 14 with respect to the neck 6.

As shown in FIG. 15, the container part 2 may comprise a dome 41 made of plastics.

The container part 2—and in particular the dome 41—can be made by thermoforming a sheet material.

Alternatively, the container part 2—and in particular the dome 41—can be made by injection moulding of plastics, or by compression moulding of plastics.

Thermoforming may comprise drawing and/or blow moulding.

The sheet material may comprise one or more layers made of a material having properties of barrier to light and/or to gases.

The sheet material can be obtained by coextrusion.

The dome 41 comprises a first end in which there is defined a connecting zone intended to be fixed to a container and a second end, opposite the first end, in which there is defined a dispensing body 45.

The dispensing body 45 comprises a side zone 46 and a base zone 47.

The container part 2 further comprises a neck portion 48—having a threaded portion 49—and a closing portion 50. The neck portion 48 further comprises an annular bead 51, arranged for interacting with an opening indicator device 53 of the cap 7, and an annular ridge 52.

The neck portion 48 may be obtained by forming plastics on the side zone 46.

The closing portion 50 may be obtained by forming plastics on the base zone 47.

The closing portion 50 and the base zone 47 are firmly fixed together and, together, define the end portion 14.

The neck portion 48 and the closing portion 50 can be obtained through compression moulding of plastics or through injection moulding of plastics.

As shown in FIG. 15, the opening indicator device may comprise a tamperproof ring 54 from which abutting elements 55 lead away, for example shaped as tabs or hooks.

Between the tamperproof ring 54 and a body 55 of the cap 7 there is defined an intended opening line 56, defined, for example, by a plurality of breakable bridge elements.

When the cap 7 is removed from the neck 6 for the first time, the abutting elements interact with the annular bead 51, causing the tamperproof ring 54 to separate from the body 55 along the intended opening line 56.

The tamperproof ring 54 separates from the body 55 along the intended opening line 56 before the end portion 14 separates from the neck 6 along the weakening line 15.

This is obtained by shaping the opening promoting device 28 and the further opening promoting device 29 in such a way that, before the closing arrangement has opened for the first time, the opening promoting device 28 and the further opening promoting device 29 are separated by a preset distance.

The opening promoting device 28 and the further opening promoting device 29 are shaped in such a way as to allow the cap 7 to rotate with respect to the end portion 14, in an initial step of the opening operations of the closing arrangement 1. The end portion 14 does not separate from the neck 6 until the cap 7 has been rotated with respect to the neck 6 by an angle having a size that is greater than a preset value, this preset value depending on the peculiar shape of the opening promoting device 28 and on the further opening promoting device 29, and in particular on the distance between the opening promoting device 28 and the further opening promoting device 29.

In the closing arrangement according to the invention it is possible to modulate the value of the distance of the cap 7 from the neck 6 at which there is the breakage along the weakening line 15 and the value of the distance of the cap 7 from the neck 6 at which the end portion 14 is removed, i.e. the seal is lost.

If the closing arrangement 1 comprises a cap 7 of the screw cap type (which is removed from the neck 6 by unscrewing) the distance of the cap 7 from the neck 6 at which there is the breakage along the weakening line 15 corresponds to a preset breakage angle, while the distance of the cap 7 from the neck 6 at which there is the removal of the end portion 14 corresponds to a certain seal loss angle.

Owing to the peculiar shape of the end portion 14, of the opening promoting device 28 and of the further opening device 29, and owing to the weakening line 15, it is possible to modulate the aforesaid distances, while maintaining great constructional simplicity of the closing arrangement 1.

The closing arrangement 1, in fact comprises only two pieces, i.e. the container part 2 and the cap 7. Known closing devices that enable the aforesaid distances to be modulated are, on the other hand, much more complex, inasmuch as they comprise at least three pieces.

Figure 17:
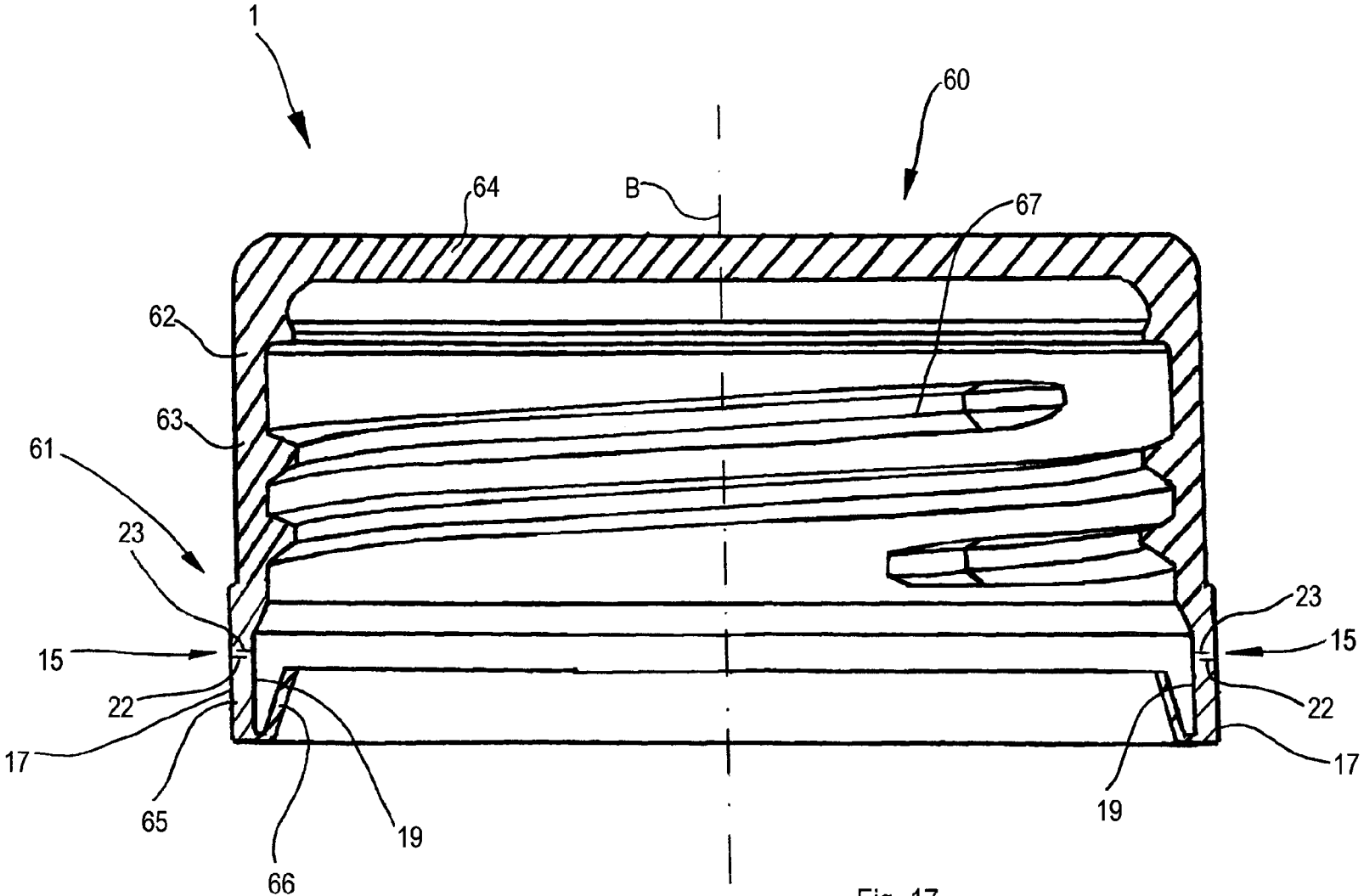
FIG. 17 is a section taken along a longitudinal plane of a cap having a body and a tamperproof ring between which a weakening line is interposed.

With reference to FIG. 17, there is shown a closing arrangement 1 comprising a cap 60 associable with a neck of a container, for example a bottle.

The cap 60 is of the screw cap type and comprises a thread 67 arranged for engaging a further thread of the aforesaid neck.

In an embodiment that is not shown, the cap 60 is of the snap cap type.

The cap 60 comprises a side wall 61 in which a weakening line 15 is provided. The weakening line 15 is interposed between a cap body 62, comprising a shell 63 and an end wall 64, and a tamperproof ring 65, comprising a tab 66 arranged for interacting with an abutting element of the aforesaid neck.

In operation, a user, by unscrewing the cap 60 from the aforesaid neck, separates the cap body 62 from the tamperproof ring 65 along the weakening line 15.

The weakening line 15 can be obtained by making one or more non-through incisions through the thickness of the neck 6.

Similarly to what is disclosed with reference to FIG. 12, the weakening line 15 comprises two non-through incisions, a first non-through incision 22 extending from the external face 17 of the wall 61 and a second non-through incision 23 extending from the internal face 19 of the wall 61.

The first non-through incision 22 and the second non-through incision 23 extend transversely to a longitudinal axis B of the cap 60. In particular, the first non-through incision 22 and the second non-through incision 23 extend substantially perpendicularly to the longitudinal axis B.

The first non-through incision 22 and the second non-through incision 23 are staggered along the longitudinal axis B.

Figure 13:
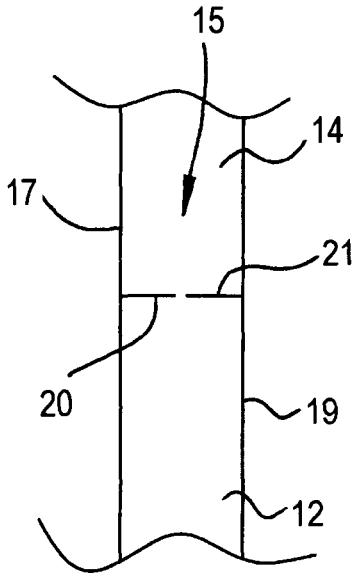
FIG. 13 is a section like the one in FIG. 11 showing another embodiment of the weakening line.

Alternatively, the weakening line may comprise non-through incisions made as disclosed above, in particular with reference to FIGS. 13 and 14.

Alternatively, as shown in FIG. 6, the weakening line 15 can be obtained by making a wall 61 provided with at least a first zone and at least a second zone having a thinner thickness than a remaining part of the wall 61, the first zone and the second zone extending from opposite faces of the wall 61.

Figure 18:
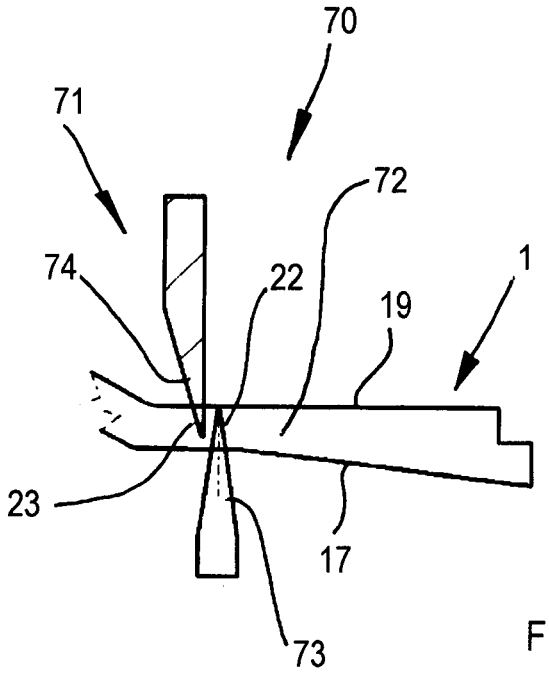
FIG. 18 is a schematic section taken along a longitudinal plane of a device for scoring a closing arrangement for obtaining a weakening line of the type shown in FIG. 12.

With reference to FIG. 18 there is shown an incision device 70, comprising a cutting arrangement 71 arranged for making non-through cuts in the thickness of a wall 72 of closing arrangement 1, the non-through cuts defining a weakening line 15.

The cutting arrangement 71 comprises a first cutting element 73 that makes a first non-through incision 22 in the wall 72 and a second cutting element 74 that makes a second non-through incision 23 in the wall 72, the first non-through incision 22 and the second non-through incision 23 being of the type disclosed with reference to FIG. 12.

Figure 19:
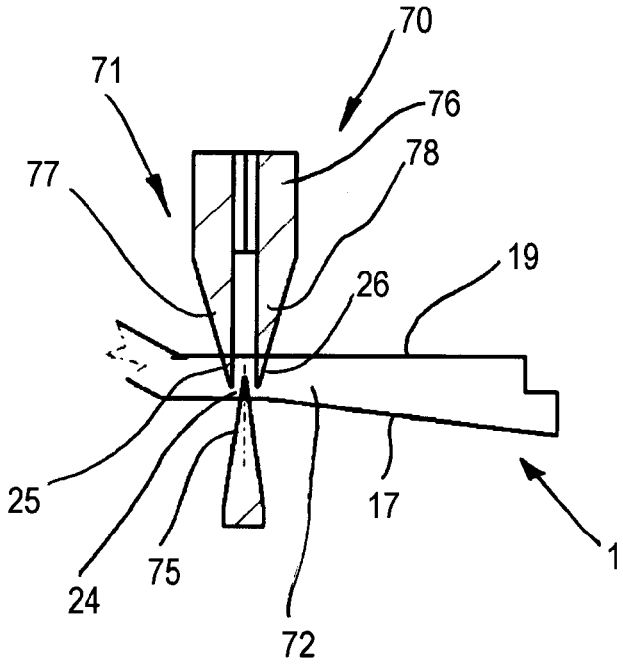
FIG. 19 is a schematic section taken along a longitudinal plane of a device for scoring a closing arrangement for obtaining a weakening line of the type shown in FIG. 14.

With reference to FIG. 19, the cutting arrangement 71 comprises a first cutting element 75 that makes a first non-through incision 24 in the wall 72 and a second cutting element 76 provided with a first cutting body 77 that makes a second non-through incision 25 in the wall 72 and with a second cutting body 78 that makes a third non-through incision 26 in the wall 72, the first non-through incision 24, the second non-through incision 25 and the third non-through incision 26 being of the type disclosed with reference to FIG. 14.

Figure 20:
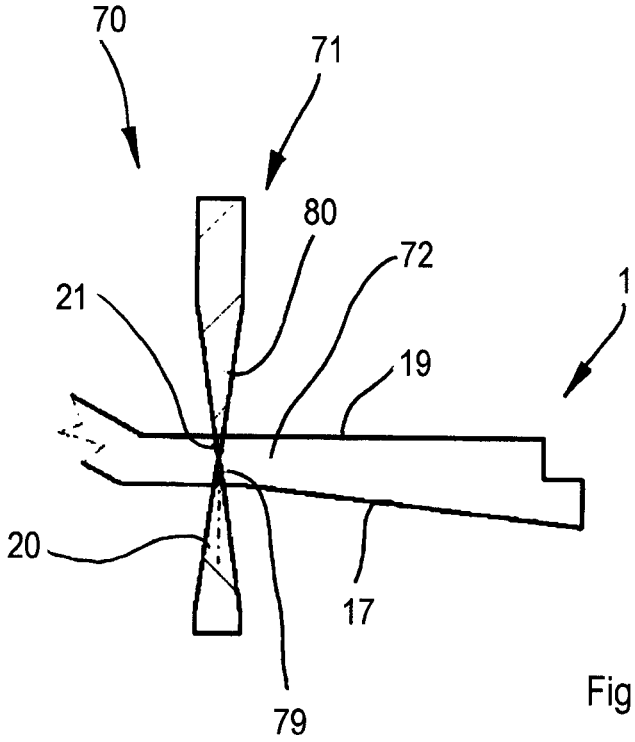
FIG. 20 is a schematic section taken along a longitudinal plane of a device for scoring a closing arrangement for obtaining a weakening line of the type shown in FIG. 13.

With reference to FIG. 20, the cutting arrangement 71 comprises a first cutting element 79 that makes a first non-through incision 20 in the wall 72 and a second cutting element 80 that makes a second non-through incision 21 in the wall 72, the first non-through incision 20 and the second non-through incision 21 being of the type disclosed with reference to FIG. 13.

Figure 21:
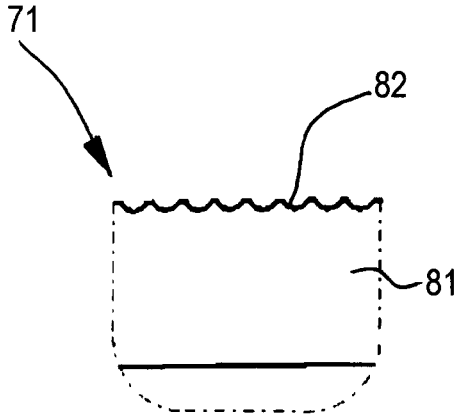
FIG. 21 is a side view of a blade of a device for scoring a closing arrangement.

With reference to FIG. 21, the cutting arrangement 71 may comprise a blade 81 having a shaped profile 82. The blade 81 makes in the closing arrangement 1 a weakening line 15 having a width—measured along the thickness of the wall 72—that is not constant. The weakening line 15 in fact comprises zones of lesser width interposed between zones of greater width.

The zones of lesser size define a plurality of primer points from which the breakage of the closing arrangement 1 along the weakening line 15 spreads.

Figure 23:
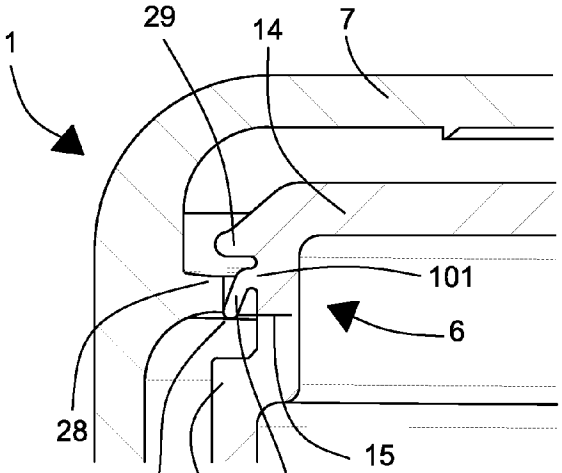
FIG. 23 is a section like the section of FIG. 22 showing the closing arrangement in an assembly configuration.
Figure 22:
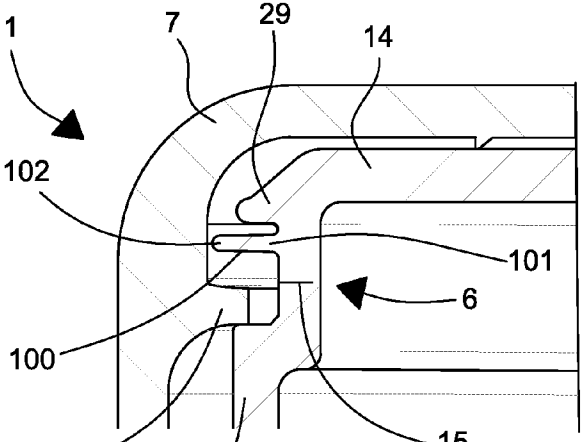
FIG. 22 is a section taken along a longitudinal plane of a still further embodiment of the closing arrangement, in a closed configuration.
Figure 24:
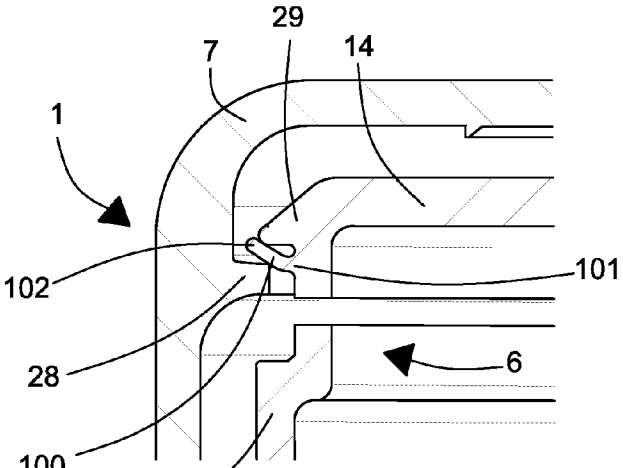
FIG. 24 is a section like the section of FIG. 22 showing the closing arrangement in an open configuration.

FIGS. 22 to 24 illustrate a still further embodiment of the closing arrangement 1 according to the invention, in which the further opening promoting device 29 is associated to a further tab arrangement 100 having an end 101 hinged on the neck 6 and a further end 102 opposite the end 101, arranged for interacting with the opening promoting device 28.

The further tab arrangement 100 may comprise a plurality of distinct tabs, or a continuous tab extending through the whole circumference of the neck 6 or only through a portion thereof.

The further tab arrangement 100 may have a variable height in order to promote a progressive breaking of the weakening line 15 and reduce the force required to cause the breaking of the weakening line 15.

When the cap 7 is assembled with the neck 6, the further tab arrangement 100 is deformed elastically by the opening promoting device 28 making the assembly of the cap 7 with the neck 6 (FIG. 23) easier.

When the cap 7 is removed, the further tab arrangement 100 is deformed by the opening promoting device 28 until it comes in contact with the further opening promoting device 29 so as to act, in conjunction with the further opening promoting device 29, as a rigid element which makes easier the breaking of the weakening line 15 easier.

Figure 26:
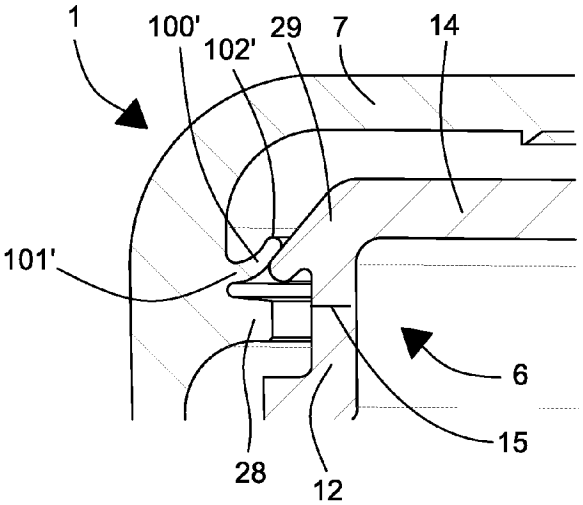
FIG. 26 is a section like the section of FIG. 25 showing the closing arrangement in an assembly configuration.
Figure 27:
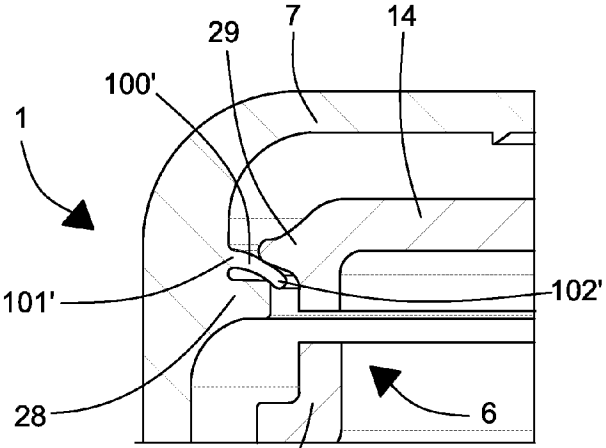
FIG. 27 is a section like the section of FIG. 25 showing the closing arrangement in an open configuration.
Figure 25:
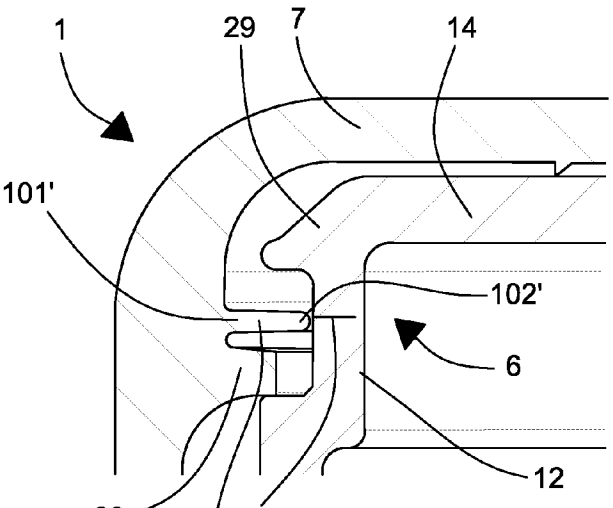
FIG. 25 is a section taken along a longitudinal plane of another embodiment of the closing arrangement, in a closed configuration.

FIGS. 25 to 27 show a variation of the embodiment shown in FIGS. 22 to 24, in which a further tab arrangement 100' is associated to the opening promoting device 28.

The further tab arrangement 100' has an end 101' hinged on the cap 7 and a further end 102' opposite the end 101', arranged for interacting with the further opening promoting device 29.

The further tab arrangement 100' may comprise a plurality of distinct tabs, or a continuous tab extending through the whole circumference of the cap 7 or only through a portion thereof.

The further tab arrangement 100' may have a variable height in order to promote a progressive breaking of the weakening line 15 and reduce the force required to cause the breaking of the weakening line 15.

When the cap 7 is assembled with the neck 6, the further tab arrangement 100' is deformed elastically by the further opening promoting device 29 making the assembly of the cap 7 with the neck 6 easier (FIG. 26).

When the cap 7 is removed, the further tab arrangement 100' is deformed by the further opening promoting device 29 until it comes in contact with the opening promoting device 28 so as to act, in conjunction with the opening promoting device 28, as a rigid element which makes the breaking of the weakening line 15 easier.

Figure 29:
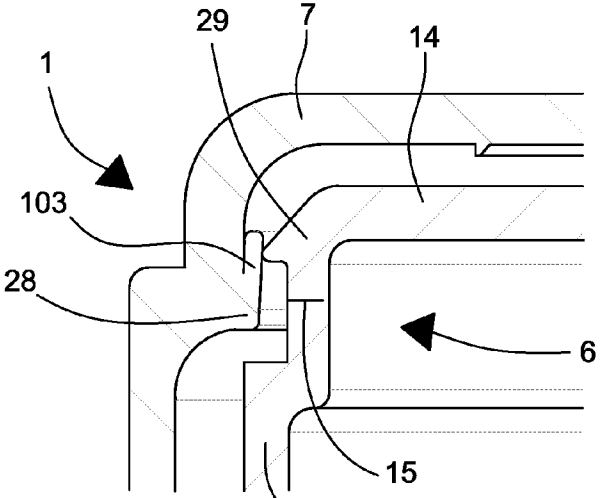
FIG. 29 is a section like the section of FIG. 28 showing the closing arrangement in an assembly configuration.
Figure 28:
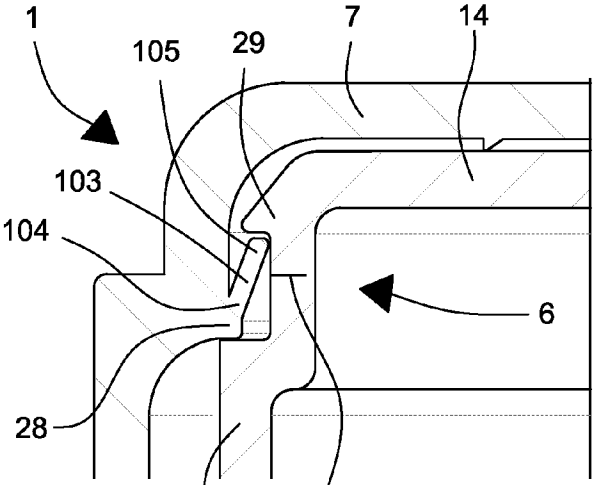
FIG. 28 is a section taken along a longitudinal plane of still another embodiment of the closing arrangement, in a closed configuration.
Figure 30:
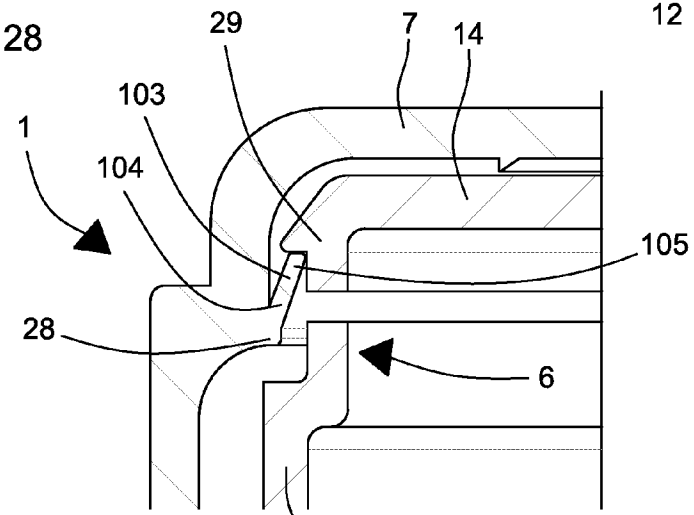
FIG. 30 is a section like the section of FIG. 28 showing the closing arrangement in an open configuration.

FIGS. 28 to 30 illustrate another embodiment of the closing arrangement 1 according to the invention, in which the opening promoting device 28 comprises a tab arrangement 103 having an end 104 hinged on the cap 7 and a further end 105, opposite the end 104, arranged for interacting with the further opening promoting device 29. The tab arrangement 103 may comprise a plurality of distinct tabs, or a continuous tab extending through the whole circumference of the cap 7 or only through a portion thereof.

The tab arrangement 103 may have a variable height in order to promote a progressive breaking of the weakening line 15 and reduce the force required to cause the breaking of the weakening line 15.

When the cap 7 is assembled with the neck 6, the tab arrangement 103 is deformed elastically by the further opening promoting device 29 making the assembly of the cap 7 with the neck 6 easier (FIG. 29).

When the cap 7 is removed, the tab arrangement 103 exerts a thrust against the further opening promoting device 29 causing the breaking of the weakening line 15 and the detachment of the end portion 14 from the neck 6 (FIG. 30).

Figure 32:
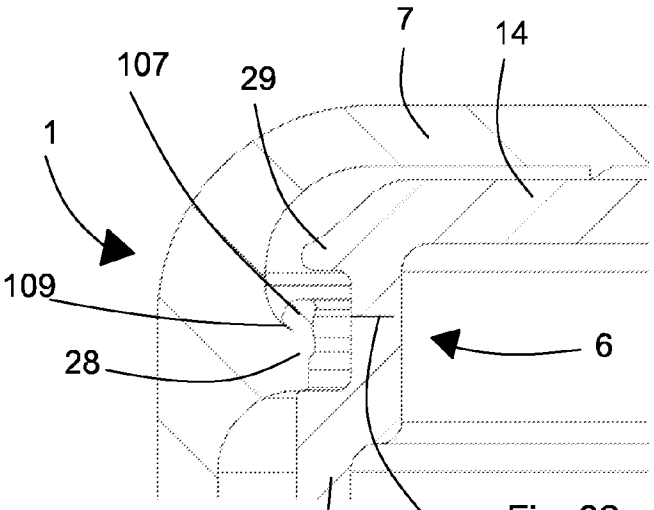
FIG. 32 is a section taken along a longitudinal plane of a still further embodiment of the closing arrangement, in a closed configuration.
Figure 31:
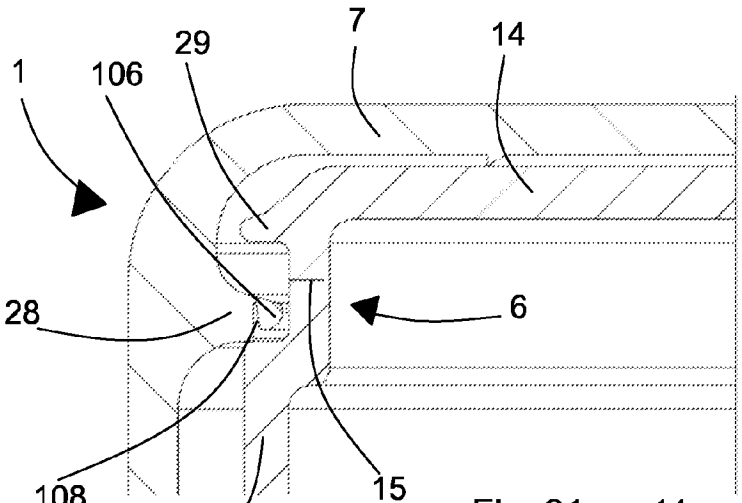
FIG. 31 is a section taken along a longitudinal plane of a further embodiment of the closing arrangement, in a closed configuration.

FIGS. 31 and 32 illustrate, respectively, a first and second variation of the embodiment of the closing arrangement 1 illustrated in FIGS. 28 to 30.

In both the first and second variation the opening promoting device 28 is provided with an elastically deformable end portion 106 and 107, respectively, suitable to interact with the further opening promoting device 29 to cause the breaking of the weakening line 15 when the cap 7 is removed. In the first variation (FIG. 31) a non-through incision 108 facing downward is provided between the end portion 106 and the opening promoting device 28 to allow the end portion 106 to rotate with respect to the opening promoting device 28.

In the second variation (FIG. 32) a non-through incision 109 facing upward is provided between the end portion 107 and the opening promoting device 28 to allow the end portion 107 to rotate with respect to the opening promoting device 28.

Figure 34:
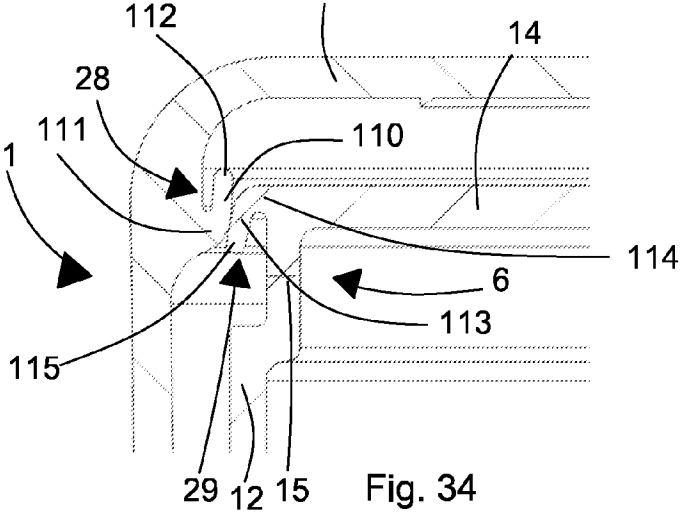
FIG. 34 is a section like the section of FIG. 33 showing the closing arrangement in an assembly configuration.
Figure 33:
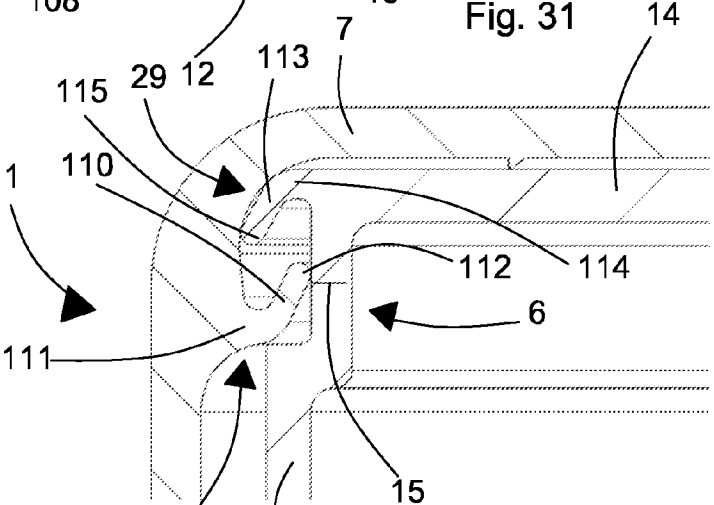
FIG. 33 is a section taken along a longitudinal plane of another embodiment of the closing arrangement, in a closed configuration.
Figure 36:
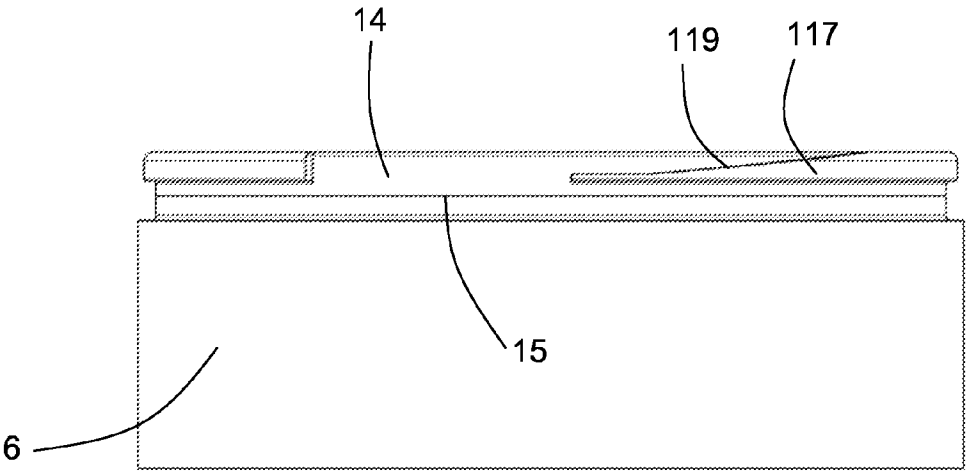
FIG. 36 is an elevational view of still another embodiment of the closing arrangement.
Figure 35:
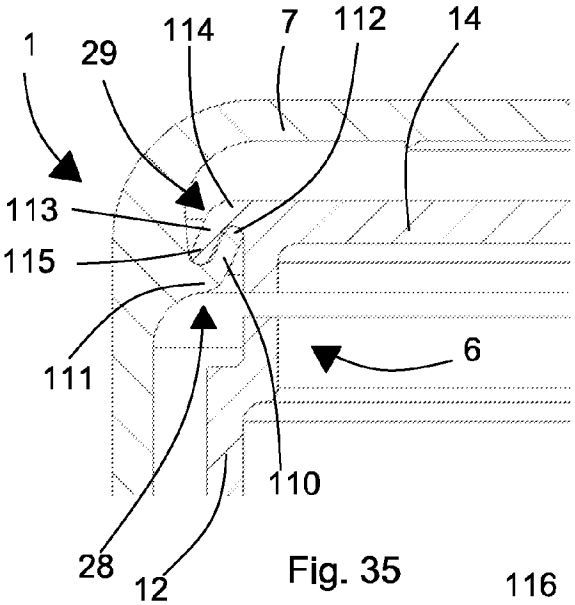
FIG. 35 is a section like the section of FIG. 33 showing the closing arrangement in an open configuration.
Figure 37:
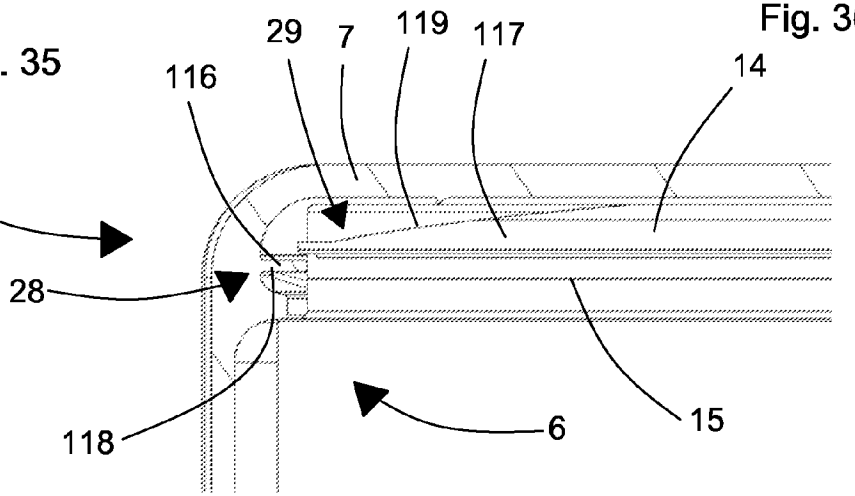
FIG. 37 is a section taken along a longitudinal plane of the closing arrangement of FIG. 36, in a closed configuration.

FIGS. 33 to 35 illustrate a further embodiment of the closing arrangement 1 according to the invention.

In this embodiment, the opening promoting device 28 comprises a first tab arrangement 110 having an end 111 hinged on the cap 7 and a further end 112 opposite the end 111, arranged for interacting with the further opening promoting device 29.

The further opening promoting device 29 comprises a second tab arrangement 113 having an end 114 hinged on the neck 6 and a further end 115 opposite the end 114, arranged for interacting with the first tab arrangement 110 of the opening promoting device 28.

The first tab arrangement 110 and the second tab arrangement 113 may comprise a plurality of distinct tabs, or a continuous tab extending through the whole circumference of the cap 7 and the neck 6, respectively, or only through a portion thereof.

The first tab arrangement 110 may have a variable length in order to promote a progressive breaking of the weakening line 15 and reduce the force required to cause the breaking of the weakening line 15.

When the cap 7 is assembled with the neck 6, the first tab arrangement 110 and the second tab arrangement 113 are deformed elastically making the assembly of the cap 7 with the neck 6 easier (FIG. 34).

When the cap 7 is removed, the first tab arrangement 110 and the second tab arrangement 113 interlock with each other causing the breaking of the weakening line 15 and the detachment of the end portion 14 from the neck 6 (FIG. 35).

FIGS. 36 to 39 illustrate a still further embodiment of the closing arrangement 1 according to the invention. In this embodiment, the opening promoting device 28 comprises at least one radial protrusion 116 provided on the cap 7 and facing toward the neck 6 and the further opening promoting device 29 comprises at least one further radial protrusion 117 provided on the end portion 14 of the neck 6 and facing toward the cap 7. The at least one radial protrusion 116 of the cap 7 has an inclined surface 118 facing downward whereas the at least one further radial protrusion 117 of the end portion 14 has an inclined surface 119 facing upward.

A plurality of radial protrusions 116 can be provided on the cap 7 and a plurality of further radial protrusions can be provided on the end portion 14 of the neck 6.

Figure 38:
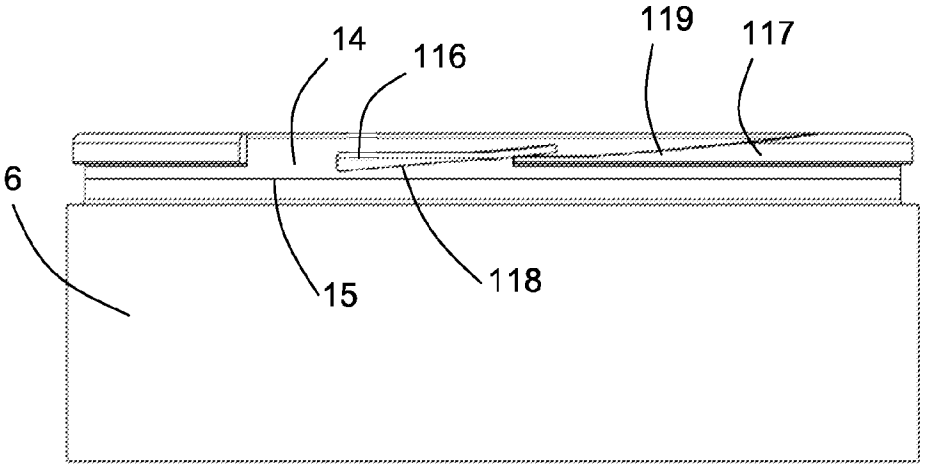
FIG. 38 shows the closing arrangement of FIG. 36 in an assembly configuration.

When the cap 7 is assembled with the neck 6 by being rotated in a first direction with respect to the neck 6, the inclined surfaces 118 of the radial protrusions 116 slide on the inclined surfaces 119 of the further radial protrusions 117 making easier the assembly of the cap 7 with the neck 6 (FIG. 38).

Figure 39:
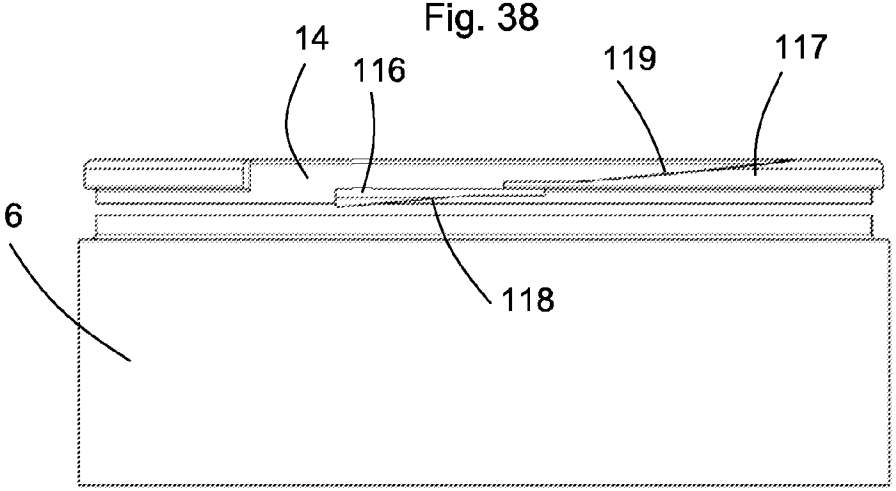
FIG. 39 shows the closing arrangement of FIG. 36 in an open configuration.

When the cap 7 is removed by being rotated with respect to the neck 6 in a second direction opposite to said first direction, the radial protrusions 116 insert themselves under the further radial protrusions 118 and push them upward causing the breaking of the weakening line 15 and the detachment of the end portion 14 from the neck 6 (FIG. 39).

Figure 40:
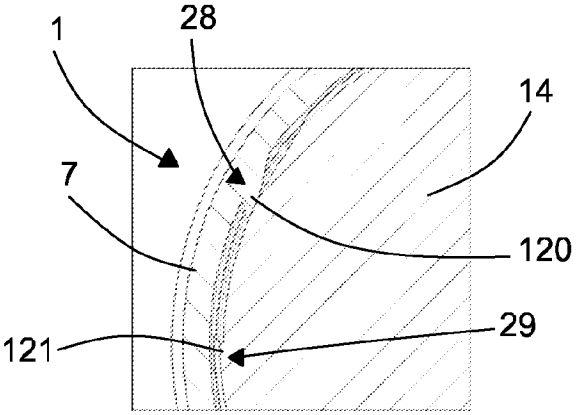
FIG. 40 is a cross section of further embodiment of the closing arrangement, in a closed configuration.
Figure 41:
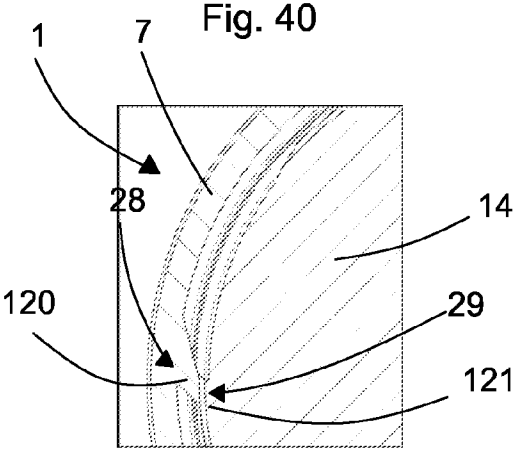
FIG. 41 is a cross section of the closing arrangement of FIG. 40, in an assembly configuration.

FIGS. 40 to 42 illustrate another embodiment of the closing arrangement 1 according to the invention.

In this embodiment the opening promoting device 28 comprises at least one radial projection 120, in particular a plurality of radial projections, provided in the cap 7 and facing toward the neck 6 and the further opening promoting device 29 comprises at least one further radial projection 121, in particular a plurality of radial projections, provided in the end portion 14 of the neck 6 and facing toward the cap 7.

When the cap 7 is assembled with the neck 6 by being rotated in a first direction with respect to the neck 6, the radial projections 120 slide on the further radial projections 121 making easier the assembly of the cap 7 with the neck 6 (FIG. 41).

When the cap 7 is removed by being rotated with respect to the neck 6 in a second direction opposite to said first direction, the radial projections 120 engage the further radial projections 121 causing a torsional breaking of the weakening line 15 and the detachment of the end portion 14 from the neck 6 (FIG. 42).

FIG. 43 illustrates two still further embodiments of the closing arrangement 1 according to the invention. A first still further embodiment is illustrated in the left half of FIG. 43, while a second still further embodiment is illustrated in the right half and in FIGS. 43 and 43A.

In the first still further embodiment the neck 6 is provided with an end portion 14' having a convex shape. The convex shape of the end portion 14' is aimed to compensate the deformation to which the end portion 14' is subject when the cap 7 is opened breaking the weakening line 15, in order to avoid that the deformation may cause a disengagement of the opening promoting device 28 from the further opening promoting device 29, thus making impossible to break the weakening line 15. In addition, the convex shape of the end portion 14' makes the assembly of the cap 7 on the neck 6 easier.

In the second still further embodiment, the end portion 14" of the neck 6 is provided with a peripheral portion 122, inclined toward the neck 6. The peripheral portion 122 is aimed to compensate the above mentioned deformation of the end portion 14".

The peripheral portion 122 may be divided into a plurality of sections 122A separated from each other by respective ribs 122B which give the peripheral portion 122 a greater stiffness, to improve the compensation of the above-mentioned deformation. In addition the peripheral portion 122 makes easier the assembly of the cap 7 on the neck 6.

FIGS. 44 and 45 illustrate another embodiment of the closing arrangement 1 according to the invention in which the neck 6 is provided with an annular inner protrusion 123 arranged immediately below the weakening line 15. This inner annular protrusion constitutes a guide for a flow of liquid to be poured from a container through the neck 6, to prevent burrs caused by the breaking of the weakening line 15 that may deviate the flow of liquid.

Figure 46:
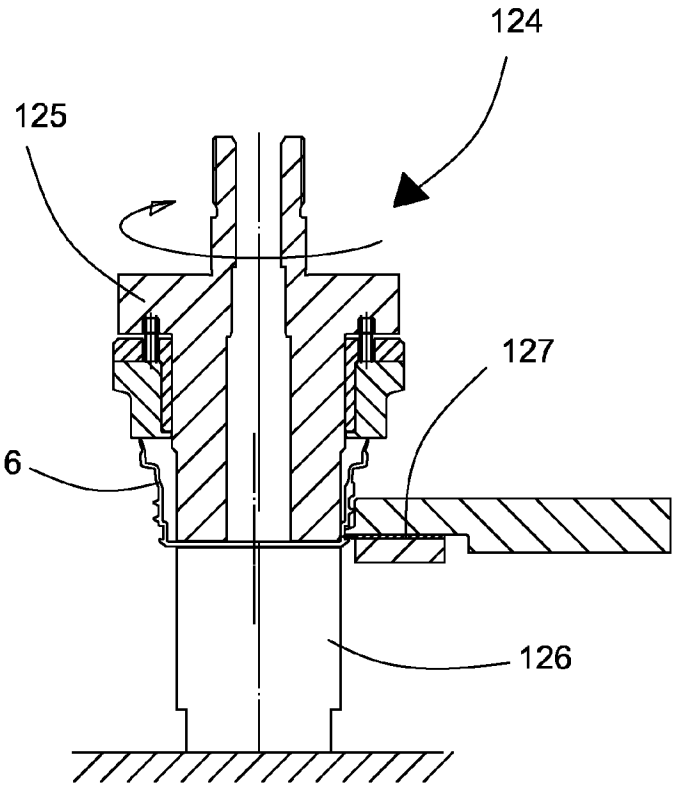
FIG. 46 is a section taken along a longitudinal plane of a further device for scoring a closing arrangement for obtaining a weakening line.

FIG. 46 illustrates an embodiment of a scoring device 124 to score a weakening line 15 in the neck 6.

The scoring device 124 comprises a mandrel 125 that may be inserted into the neck 6 to guide the neck 6 during scoring operations and a support element 126 on which the neck 6 rests during scoring operations.

In order to score the weakening line 15 the neck 6 is brought in contact with a cutting element 127 and moved so as to roll on the cutting element 127 guided by the mandrel 125.

The mandrel 125 may be rotated in order to cause the neck 6 to roll and slide on the cutting element 127, in order to facilitate the scoring of the weakening line 15.

Figure 47:
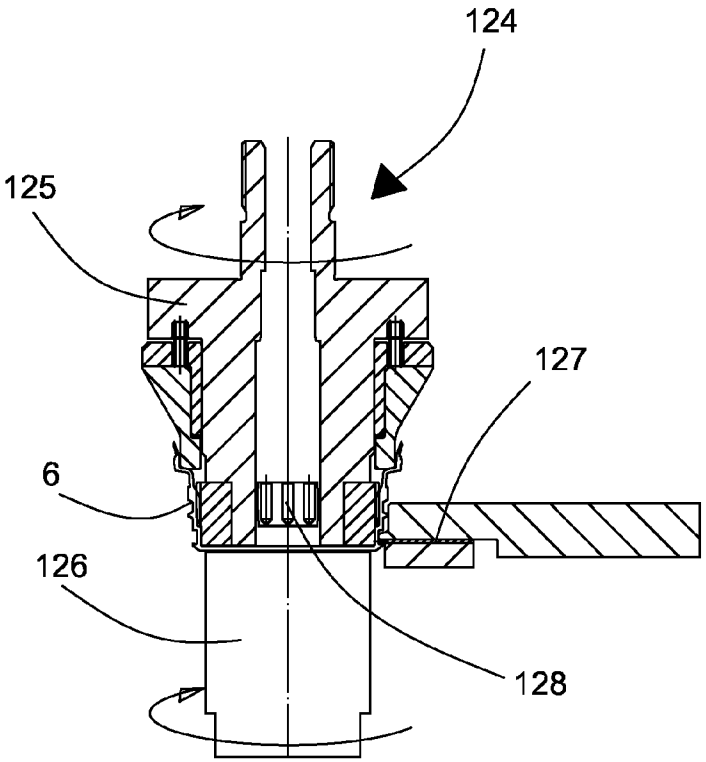
FIG. 47 is a section taken along a longitudinal plane of a still further device for scoring a closing arrangement for obtaining a weakening line.

FIG. 47 illustrate another embodiment of the scoring device 124, in which the mandrel 125 is provided with indentations 128 that engage with corresponding indentations provided in the neck 6 (not shown) to obtain a stable coupling of the neck 6 with the mandrel 125 and prevent any rotation of the neck 6 with respect to the mandrel 125.

In addition, the support element 126 may be made rotatable around an axis coinciding with an axis of the mandrel 125 in order to eliminate friction between the neck 6 and the support element 126 when the neck is guided on the cutting element 127. Eliminating said friction has the advantage of preventing any possible damage to the neck caused by said friction.

The invention claimed is:

1. A closing arrangement, comprising a neck for receiving a cap, said neck having an end closed by a wall, said end containing a weakening line, said weakening line comprising at least one non-through incision through the thickness of said neck, said wall being provided with a first opening promoting device arranged for engaging a second opening promoting device of said cap to separate at least a part of said wall from said neck along said weakening line.

2. A closing arrangement according to claim 1, wherein said at least one non-through incision comprises a non-through cut made by a cutting tool.

3. A closing arrangement according to claim 2, wherein said at least one non-through cut is made by an ultrasound device or laser device.

4. A closing arrangement according to claim 1, wherein said neck and said wall are made as a monobloc.

5. A closing arrangement according to claim 1, wherein said at least one non-through incision is below said first opening promoting device at a distance thereof.

6. A closing arrangement according to claim 1, wherein said at least one non-through incision extends from an external face of a lateral wall of said neck.

7. A closing arrangement according to claim 1, wherein said at least one non-through incision surrounds said neck.

8. A closing arrangement according to claim 1, wherein said first opening promoting device and said second opening promoting device cooperate with a base wall of said cap for defining a containing zone that retains said at least a part of said wall, after said at least a part of said wall has been separated from said neck, and wherein before said cap is removed from said neck for the first time, said first opening promoting device and said second opening promoting device are separated by a preset distance.

9. A closing arrangement according to claim 1, wherein said weakening line is defined by at least a weakened portion extending transversely to a longitudinal axis of said closing arrangement.

10. A closing arrangement according to claim 1, wherein said weakening line is defined by at least a weakened portion extending substantially parallel to a longitudinal axis of said closing arrangement.

11. A closing arrangement according to claim 1, wherein said weakening line is defined by at least a first weakened portion and at least a second weakened portion, said at least a first weakened portion and said at least a second weakened portion extending from opposite sides of a wall of said neck end through a part of the thickness of said wall.

12. A closing arrangement according to claim 11, wherein said at least a first weakened portion and said at least a second weakened portion are mutually aligned.

13. A closing arrangement according to claim 11, wherein said at least a first weakened portion and said at least a second weakened portion are mutually staggered.

14. A closing arrangement according to claim 1, and further comprising a seal arrangement arranged for making a seal between said cap and said neck after said at least a part of said wall has been separated from said neck.

15. A closing arrangement according to claim 1, and further comprising a container part provided with an end zone and with a container body, said container part comprising a dome, said dome comprising a material that is a barrier to gases and/or to light, said neck comprising a threaded portion distinct from said dome and applied to said dome, said threaded portion being arranged for engaging a further threaded portion of said cap.

16. A closing arrangement according to claim 1, and further comprising a cap associated with said neck.

* * * * *